US008523397B1

(12) United States Patent
Gordin

(10) Patent No.: US 8,523,397 B1
(45) Date of Patent: Sep. 3, 2013

(54) METHOD AND APPARATUS TO PROVIDE UP-LIGHT FOR AERIAL VIEWING AND EFFECTIVELY CONTROL GLARE AND SPILL LIGHT

(75) Inventor: Myron K. Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 191 days.

(21) Appl. No.: 11/763,867

(22) Filed: Jun. 15, 2007

Related U.S. Application Data

(60) Provisional application No. 60/814,064, filed on Jun. 16, 2006.

(51) Int. Cl.
*F21V 21/26* (2006.01)

(52) U.S. Cl.
USPC ..... 362/269; 362/297; 362/359

(58) Field of Classification Search
USPC ..... 362/269, 275, 297, 307, 344, 346, 362/348, 351, 354, 359, 361, 539
See application file for complete search history.

(56) References Cited

U.S. PATENT DOCUMENTS

| | | | | |
|---|---|---|---|---|
| 1,412,411 | A * | 4/1922 | McInroy | 362/341 |
| 1,508,791 | A | 9/1924 | Hoffman et al. | |
| 1,708,561 | A | 4/1929 | Aud | |
| 1,997,026 | A | 4/1935 | Weddel | |
| 4,816,974 | A | 3/1989 | Gordin | |
| 4,947,303 | A | 8/1990 | Gordin et al. | |
| 5,075,828 | A | 12/1991 | Gordin et al. | |
| 5,161,883 | A | 11/1992 | Gordin | |
| 5,211,473 | A | 5/1993 | Gordin | |
| 5,595,440 | A | 1/1997 | Gordin | |
| 5,707,142 | A | 1/1998 | Gordin | |
| 6,036,338 | A | 3/2000 | Gordin | |
| 6,203,176 | B1 | 3/2001 | Gordin | |
| 7,070,303 | B2 | 7/2006 | Kassay et al. | |
| 7,467,880 | B2 * | 12/2008 | Gordin et al. | 362/359 |
| 7,540,629 | B2 | 6/2009 | Steinberg | |
| 7,568,818 | B2 | 8/2009 | Pfund | |

(Continued)

OTHER PUBLICATIONS

Musco Lighting, "SportsCluster2" copyright 2002, 2004 [online] [retrieved on May 31, 2007] Retrieval using Internet <URL:http://www.musco.com/permanent/sportscluster2.html>, (2 pages).
Musco Lighting, "Total Light Control" copyright 2002, 2004 [online] [retrieved on May 31, 2007] Retrieval using Internet <URL: http://www.musco.com/permanent/tlc.html>, (2 pages).

(Continued)

*Primary Examiner* — Hargobind S Sawhney
(74) *Attorney, Agent, or Firm* — McKee, Voorhees & Sease, P.L.C.

(57) ABSTRACT

An apparatus, method, and system to provide, as one example, up-light for aerial viewing from downwardly aimed wide area, high intensity, lighting fixtures. The method controls a small percentage of light from the fixture to pass up and away for up-light, with the remainder used to produce a controlled, concentrated beam to a target. Some embodiments include a substantial amount of glare and spill light control. An apparatus can include a lamp and fixture with a visor length that is shorter than most conventional spill and glare control visors. The visor allows a controlled, relatively small percentage of direct light from the fixture for a desired or needed level of aerial illumination, but efficiently directs other light to the target. Optionally, a reflective plate is positioned inside the visor to reflect a small percentage of light from the fixture upwardly for up-light. Another embodiment can shift a fraction of light in direction(s) different than the main light output of the fixture.

17 Claims, 49 Drawing Sheets

(56) References Cited

U.S. PATENT DOCUMENTS

| | | | |
|---|---|---|---|
| 2006/0176695 | A1 | 8/2006 | Gordin |
| 2006/0181875 | A1 | 8/2006 | Gordin |
| 2006/0181882 | A1 | 8/2006 | Gordin |
| 2006/0198145 | A1 | 9/2006 | Gordin |

OTHER PUBLICATIONS

Musco Lighting, "Level 8" copyright 2002, 2004 [online] [retrieved on May 31, 2007] Retrieval using Internet <URL: http://www.musco.com/permanent/level8.html>, (2 pages).

* cited by examiner

| Lighting Equipment | | | | | |
|---|---|---|---|---|---|
| APPROXIMATE FOOTCANDLE LEVEL: | 100/70 FC | | | LAMP TYPE: | 1500W MH |
| MAX. TO MIN. RATIO NOT TO EXCEED: | 1.5:1/2:1 | | | FINISH: | Galvanized |
| POLE | | | | LUMINAIRES | |
| POLE QUANTITY | POLE LOCATION | MOUNTING HEIGHT | ELEV. | FIXTURES PER POLE /UNIT | TOTAL |
| 1 | A1 | 100' | 0 | 13 | 13 |
| 1 | A2 | 100' | 0 | 13 | 13 |
| 1 | B1 | 80' | 0 | 24 | 24 |
| 1 | B2 | 80' | 0 | 24 | 24 |
| 1 | C1 | 80' | 0 | 10 | 10 |
| 1 | C2 | 80' | 0 | 10 | 10 |
| 1 | D1 | 80' | 0 | 10 | 10 |
| 1 | D2 | 80' | 0 | 10 | 10 |
| 8 | ← TOTALS → | | | 114 | |

FIG 2B

5" VISOR W/ UPLIGHT LOUVER
DESIGN EMBODIMENT 1

METHOD AND APPARATUS TO PROVIDE UP-LIGHT FOR AERIAL VIEWING AND EFFECTIVELY CONTROL GLARE AND SPILL LIGHT

REFERENCE TO RELATED APPLICATIONS

This application claims priority to U.S. Provisional Application Ser. No. 60/814,094, filed Jun. 15, 2006, the entire contents of which is incorporated by reference herein.

INCORPORATION BY REFERENCE

The entire contents of the following U.S. Patents and pending U.S. Patent Applications are incorporated by reference herein: U.S. Pat. No. 4,816,974; U.S. Pat. No. 5,211,473; U.S. Pat. No. 5,161,883; U.S. Pat. No. 5,707,142; U.S. Pat. No. 6,203,176; US publication No. 2006/0198145, now U.S. Pat. No. 7,458,700; US publication No. 2006/0176695; US publication No. 2006/0181882; and US publication No. 2006/0181875, now U.S. Pat. No. 7,789,540.

BACKGROUND OF THE INVENTION

A. Field of the Invention

The present invention relates to wide area lighting systems which utilize a plurality of light fixtures elevated at substantial heights relative to an area or volume of space to be lighted. Examples are disclosed at U.S. Pat. No. 4,816,974; U.S. Pat. No. 5,211,473; U.S. Pat. No. 5,161,883; U.S. Pat. No. 5,707,142; US publication No. 2006/0198145, now U.S. Pat. No. 7,458,700; US publication No. 2006/0176695; US publication No. 2006/0181882; and US publication No. 2006/0181875, now U.S. Pat. No. 7,789,540. In particular, the invention relates to methods and apparatus to provide direct illumination on aerial objects or to a volume of aerial space, control the direction and intensity of light to reduce glare for viewers within the target area, and reduce glare and spill light outside the target area.

B. Issues in the Present State of the Art

In relatively recent times, substantial effort has gone into the development of methods to counter-act spill and glare light concerns in wide area lighting installations. Glare and spill light, and halo effect light, are referred to by some as light pollution. Sometimes lighting systems are not allowed to be installed and operated unless they meet glare and spill light restrictions or regulations. These restrictions and regulations can be quite stringent.

Light pollution remediation methods also, therefore, have to be quite stringent. State of the art glare and spill light control methods may meet glare and spill restrictions or regulations, but do not always adequately address aerial illumination needs. Or they do not always do so efficiently or economically. A good example is sports lighting. To meet glare and spill requirements, illumination levels above the playing field might be attenuated to the extent it affects playability. By playability, it is meant that there may be insufficient illumination of the volume of space, or parts of it, above a playing field for the players to follow, for example, the flight of a ball. Glare and spill light control usually involves attenuation or redirection of light, which can remove or prevent light from adequate illumination of relevant aerial space.

Similar issues of inadequate aerial illumination can exist for other type of wide-area or flood lighting. There may be situations where general wide area lighting requires aerial viewing of fixed or moving objects. An example might be illumination of tall monuments, or other elevated or vertically tall objects. Another example might be security lighting. As can be appreciated, glare and spill light control may affect either the amount or consistency of aerial illumination for similar reasons as discussed above regarding sports lighting.

On the other hand, some state of the art lighting products provide adequate aerial illumination but do not adequately address glare and spill light. With respect to sports lighting as an example, some conventional sports lighting fixtures utilize symmetrical bowl-shaped reflectors and high intensity discharge (HID) lamps centered along the axis of revolution of the reflector. While this long-used, conventional-type fixture provides a relatively controlled and concentrated beam for use with other such fixtures in providing illumination of an entire playing field, the symmetry of the reflector results in light reflecting upwardly and outwardly from the lower hemisphere. As a result, this can produce an adequate level of direct aerial lighting over the playing field. However, it can also produce glare and spill light. Some of the light can project to sites off the playing field. Glare can exist for on-site spectators or off-site viewers of the lights.

Therefore, providing both adequate lighting, including effective aerial lighting from multiple fixtures, as well as controlling lighting issues such as glare, spill light, and up-light from high intensity wide area lighting, is difficult to achieve. Designs and methods for addressing one of these aspects are often in direct conflict with another of these aspects.

More specifically, glare and spill light are well-known and significant issues for high intensity wide area lighting. In the wide-area lighting example of sports lighting, such lights are typically elevated high into the air (usually at least 35 feet, and more likely 70 to 120 feet or more) and they can also be relatively distant from their target (hundreds of feet). Light, by basic laws of physics, tends to disperse with distance. While state of the art high intensity sports lighting is designed to try to capture and control as much light as possible to the target, and uses relatively narrow, concentrated beams for those purposes, some light tends to spill off the target (e.g. the playing field). Also, many times observers located quite a distance away from the lights and the target, as well as observers near the target, have a direct view of either the light source or the reflective surface of at least one fixture, and sometimes more than one. The high power and nature of these lamps and fixtures can produce a significant glare effect to such observers, especially since glare intensity (candlepower) does not diminish with distance; unlike illumination which diminishes in proportion to the square of the distance (i.e. foot-candles at a given point is calculated by dividing candlepower by the distance squared). These issues are well-known in the art.

To counter-act problems with spill and glare from high intensity wide area lighting fixtures, a variety of products have been attempted or developed by a variety of companies. Some specific glare and spill light control products and methods have been developed by MUSCO® Corporation of Oskaloosa, Iowa USA. Examples can be found with commercially available products such as SPORTCLUSTER-2®™, TOTAL LIGHT CONTROL™ (or TLC™), LEVEL-8™, and LIGHT-STRUCTURE GREEN™ systems from MUSCO® Corporation and/or U.S. patents such as U.S. Pat. No. 4,816,974; U.S. Pat. No. 5,211,473; U.S. Pat. No. 5,161,883; U.S. Pat. No. 5,707,142.

Many of these methods use the conventional bowl-shaped reflector. Some add a visor for glare and spill control. But, as discussed in more detail later, to achieve glare and spill control, such visors tend to block, attenuate, or render unusable a substantial amount of light.

Some glare and spill control methods alter or configure the bottom hemisphere of a symmetrical, bowl-shaped lighting fixture to reflect more light downward to the target which might otherwise go outside the target. An example is the SPORTSCLUSER-2®™ fixture commercially available from MUSCO® Corporation. It tends to reduce glare and spill with this modification. However, without a visor, it does tend to also allow an amount of direct aerial light that is generally sufficient for playability. However, it may not have sufficient glare and spill control for at least certain applications. Therefore, some methods have been developed to provide a greater degree of glare and spill light control than fixtures without visors.

Some attempts, like louvers across the front opening or lens of the fixture, may work towards control of spill or glare, but essentially block light from exiting the fixture, which decreases their efficiency. In some cases it makes them literally impractical for use due to decreased efficiency. A reduction in light of significant amount from plural fixtures can require more light fixtures to meet light intensity and uniformity requirements of many applications, including for example sports lighting. Increasing the number of fixtures can greatly increase capital as well as operating costs for the lighting system. An example of louvers across the front of a fixture is shown and described at U.S. Pat. No. 5,707,142. Louvers 32 and 34 would block direct view of HID lamp 20 from many viewing angles, but would also block or make essentially unusable a portion of light that might otherwise project outside the playing field. U.S. Pat. No. 5,707,142 also discloses a visor 76 with an extension or outer louver 78. They would also tend to block or absorb light and decrease the efficiency of the fixture.

Some attempts use different types of visors, which also tend to block or absorb or do not effectively or efficiently redirect light from the fixture to increase glare or spill light control, as well as halo light (another form of light pollution well known in the art). However, this can likewise decrease efficiency of the fixtures and can make them less practical. The blocked or absorbed, or inefficiently directed light would not be available to illuminate the target. Examples include U.S. Pat. No. 4,816,974; U.S. Pat. No. 5,211,473; U.S. Pat. No. 5,161,883; U.S. Pat. No. 5,707,142, and/or commercially available TLC™ and LEVEL-8™ brands from MUSCO® Corporation. Many of these systems, e.g. TLC™ brand, can control glare and spill very well, but mid-field playability may sometimes be insufficient. TLC™ utilizes a blackened visor that has a distal portion that extends downward and then outward (like shown in FIGS. 1 and 3 of U.S. Pat. No. 5,707,142). This can block or absorb significant light which is usually beneficial for glare and spill control, but not for efficiency or aerial lighting. The visor extension also does not efficiently redirect light that otherwise might otherwise project up and out and be spill or aerial lighting. The visor and extension also address glare by some blocking direct view of the light source in the fixture from many on-site or off-site viewing directions. But all this can be at the expense of loss of direct aerial lighting. It can also be at the expense of loss of efficiency for the fixture or lighting system. MUSCO® Corporation Level-8™ brand fixtures, for example, can provide a good combination of glare and spill control with generally adequate mid-field playability. As can be seen at U.S. Pat. No. 5,211,473 and U.S. Pat. No. 5,161,883, for example, Level-8™ can include louvers or other members inside the visor, but the efficiency of such a fixture may be less than desirable for certain applications. By reference to U.S. Pat. No. 5,211,473 and U.S. Pat. No. 5,161,883, a variety of visors, in combination with a reformed lower hemisphere, are shown. For even more glare and spill control, visors (e.g. FIG. 27, ref. nos. 234 and 238 of U.S. Pat. No. 5,211,473), and louvers (e.g. FIG. 30, ref. nos. 246 and 256 of U.S. Pat. No. 5,211,473) are utilized. As can be seen, these internal louvers can serve to block light, other disperse light, that otherwise might project outward and upward, and block direct view of the light source for some viewers. Because, unlike TLC™, it is not almost a complete block, more direct aerial lighting can be produced. However, the louvers are angled relative to the direction of light from the fixture to block some direct view of the HID lamp, but also block or absorb some light or render it effectively not useable for the target or for aerial lighting. This can raise efficiency issues. It can also raise issues regarding consistency, uniformity, and adequacy of aerial lighting.

It can therefore be seen that not only are there situations where a balance between glare/spill control and aerial lighting must be reached, but sometimes efficiency of the fixture must be taken into account. It is difficult to balance all those factors.

Some fixtures have been developed that include special visors that decrease or minimize efficiency loss, or even increase the fixture's efficiency. They improve upon the older, less efficient visor methods by using a reflective or highly reflective inner surface that does not block or absorb light, but rather attempts to capture and control it in a useable fashion to the target. Examples of such visor systems are described in MUSCO® Corporation patent applications, see for example, US publication No. 2006/0198145, now U.S. Pat. No. 7,458,700; US publication No. 2006/0176695; US publication No. 2006/0181882; and US publication No. 2006/0181875, now U.S. Pat. No. 7,789,540.

U.S. Pat. No. 7,458,700 provides an improved method for glare and spill control with some level of playability by selective use of different visor types for key aiming directions. However, the intensity of light available for aerial illumination is limited by the visors because they are designed mainly for spill and glare control. Improvements are still needed for situations where more mid-field playability illumination is desirable.

Mid-field playability applies particularly to what can be called aerial sports (e.g. where a ball, as a part of the game, can move to locations well above the field, sometimes 130 feet or higher). Since typical sports lighting systems have fixtures elevated on poles around the outside of the field, and the fixtures are typically aimed down towards the field, the volume of space above the center of the field (e.g. mid-field) may have substantially less light. This can make it difficult for a player to follow a ball in flight, especially if it moves from higher illumination areas to lower illumination and back to higher illumination, or if the player loses continuous sight of the ball and must reacquire it. This not only reduces the enjoyment of the game, but creates concern for safety.

The diagram of FIG. 1A illustrates this. High intensity sports lighting fixtures 10 elevated over 70 feet in the air on a pole (here one pole A1 is shown), each with a plurality of fixtures 10, are used to illuminate a ball field 2 (see, e.g., FIGS. 2A-E). As indicated in FIG. 1A, normally glare and spill control tries to limit off-field light and direct view of the light source. In other words, the main beam from any fixture 10 on pole A1 would not substantially exceed upper and lower margins R(B) and R(T) in FIG. 1A. Thus, persons substantially outside field 2, like those in and around house 8 near field 2, would not experience a substantial amount of light or perceive substantial intensity from the fixtures. But note in FIG. 1A how a baseball, for example hit by batter 6A, might well travel along arc 9. The ball would be quite visible between batter 6A and upper beam limit R(T) because it would be traveling in the main beam. However outfielder 6B may lose track of the ball if it travels above beam limit R(T) because of lack of adequate illumination above limit R(T). Even though the ball might re-enter the beam (or another beam) prior to reaching outfielder 6B, this can be a problem. It can be a very real safety issue for outfielder 6B (e.g. a baseball could hit an outfielder in the head, or players could run into one another because of confusion over flight or location of the ball).

This lack of sufficient aerial lighting can occur even with many lighting fixtures aimed at the playing field from different directions. As indicated in the baseball field example of FIG. 2A, there is a particular risk of insufficient aerial lighting at the middle of the field, as well as from the middle towards the outfield. The dark straight lines in FIG. 2A indicate central aiming axes/directions of beams from plural fixtures on each of eight poles around the field. If most of the fixtures use visors or other conventional glare and spill light control features, ball flight could extend over the top margin R(T) of the beam of each fixture and present aerial illumination issues. As mentioned earlier, visors or louvers designed for glare and spill, even efficient visors that do not negatively impact illumination at the target, have at least three inherent issues that impact playability or aerial illumination.

First, they tend to be designed to cut off the light beyond the target to attempt to contain the light within the target boundary. With these what might be called fully or semi-shielded fixtures, zero or very minimal direct light is directed upward and is not sufficient for playability. For example, these types of systems tend to allow less than 0.5 foot-candle vertical ($fc_{vert}$) in the 120 to 140 foot elevation range, where baseballs frequently travel; and more frequently allow from zero to 0.2 $fc_{vert}$. As a result, only indirect up-light reflected off the field surface (e.g. generally accepted in the art as 15 percent for grass), is available for aerial illumination and viewing. However, reflected light off the target surface is dispersed in a generally uncontrolled manner and significantly diminishes with distance. Past experience has proven that indirect up-light reflected off the target surface is generally not sufficient for aerial viewing, unless an unusual highly reflective material, white rock for example, with much higher reflectivity than grass is used. Even when minimum direct light and reflected light are combined, aerial light intensity is often still inadequate for playability, especially at mid field.

Second, if glare and spill control is lessened, it may result in more light being dispersed vertically; even to the point of providing sufficient up-light for playability. One such method to achieve this is to aim the beams less steeply down from horizontal, thus providing higher intensity near horizontal. However, this will likely result in very undesirable offsite glare and spill light, even to the point of causing glare and spill problems similar to those of a fixture with no glare control (e.g. no visor or louvers). Up-light (aerial illumination) provided without louvers or visors, also disperses some light vertically, and thus can sometimes provide satisfactory aerial illumination—but with added difficulty in aerial viewing due to higher intensity viewed at a lower plane. For example, compare vertical foot-candles at 40' elevation between FIG. 3A (using MUSCO® Corporation's commercially available SportsCluster-2® fixture, having some glare and spill control but without louvers or visors) and FIG. 3C, an exemplary embodiment of the present invention. The difference is 9.25 $fc_{vert}$ in FIG. 3A and 4.80 $fc_{vert}$ in FIG. 3C. The relatively high intensity at 40' in FIG. 3A can affect the ability to perceive a ball at much higher elevation, even if there is otherwise acceptable aerial light at the higher level (i.e., because of the significant difference between light levels at low elevation and high elevation). Compare this with FIG. 3C, where less than 3 fc difference exists between 40' and 150'. Note also in FIG. 3A that light levels above 80 feet are not very consistent. In addition, without visor or louvers, the high intensity lamp arc source is visible to viewers both on the target area and offsite. The arc tube is an extremely intense source of glare and should be shielded from viewers when possible. The amount of light intensity needed to view aerial objects is directly proportional to the intensity that is present in normal viewing directions, although considerably less intense. As the intensity at normal directions increases, the amount of light needed for aerial viewing also increases, making it difficult to balance both needs. In contrast, with proper glare and spill control the intensity at normal viewing plane is reduced, thus requiring proportionally significantly lower aerial illumination. In other words, the more light at lower normal viewing directions, the more light needed above them to provide adequate viewing of aerial objects. Additionally, up-light provided by all the means described above is based on the physics of light dispersing vertically, with higher intensity levels near the target plane (e.g. the playing field surface) and diminishing in intensity with elevation. This can create a bright-dark-bright effect for objects in flight that rise through elevation and descend back down. Inconsistent light levels decrease the viewer's ability to track objects in flight. In addition, at higher elevations the light may diminish below acceptable levels, causing the object to be temporarily lost from view.

Third, even if a fixture provides some reasonable amount of up-light for playability, and also provides some reasonable amount of glare and spill control, it is difficult to do so without substantial decrease in efficiency of the light fixture.

Therefore, a need has been identified in the art for a lighting fixture or method that provides more consistent, effective aerial illumination while also providing a substantial amount of glare and spill light control.

SUMMARY OF THE INVENTION

One aspect of this invention addresses two main functions. First, sufficient and controllable up-light is provided in conjunction with glare and spill control, all without significant impact to the target. Second, up-light from the visor is maintained at a consistent level for aerial viewing, instead of even vertical dispersion that dissipates with elevation, or substantial uneven levels which can make viewing through various elevations difficult.

Another aspect of the present invention utilizes a conventional high intensity lamp and fixture but uses an innovative visor system to provide improved glare and spill control in conjunction with up-light for aerial illumination. The outer or distal visor shell length is shorter than most conventional visors used for substantial glare and spill control to allow sufficient light to pass upward to provide sufficient up-light for aerial viewing, but still maintains important glare control for viewers at the target, as well as glare and spill control for offsite viewers. The visor allows just enough direct light from the fixture to provide a desired or needed level of aerial illumination, but efficiently directs other light to the target.

One embodiment of a visor system according to an aspect of the invention uses a louver with highly reflective surface positioned to re-direct out of the fixture's beam a relatively controlled, smooth, and consistent amount of light upward. While many present lighting fixtures result in diminished intensity in relation to height (see, e.g., FIG. 3A, group of $fc_{vert}$ numbers above 60'), the present method provides very consistent aerial illumination levels (see FIG. 3C, group of $fc_{vert}$ numbers above 60'), even at much higher elevations than previously possible with conventional methods. In one embodiment of a louver, the light directed upward is taken from the center of the light beam (reflected off the back of the reflector, see, e.g., FIG. 1B). This has minimal impact on the target illumination but allows for gathering of sufficient light for up-light use. In contrast, gathering light from the bottom of the beam (the light off the upper portion of the reflector or the upper visor surface) will generally result in lack of intensity needed for up-light. Thus, the method according to this aspect of the invention promotes an efficient visor system with minimum impact on target illumination, provides substantial glare and spill control, and produces a very consistent level of aerial illumination that does not diminish proportionally to elevation change.

Another aspect of the invention uses the shortened visor described above alone to achieve some glare and spill control, but allowing additional controlled light from the lower hemisphere of the reflector of the fixture to create a higher level of up-lighting than with the longer, conventional visors. The shortened visor may sacrifice some glare and spill control, but produces the benefit of more aerial lighting.

Another aspect of the invention uses the above-described shortened visor but instead of just the visor alone or the visor and louver, an insert or other modification to the bottom hemisphere of the reflector of the fixture is made which directs some controlled, additional light upward for additional up-lighting. While this takes away some light from the target, and may reduce some glare or spill control, it provides a small amount of direct aerial illumination.

Another aspect of the invention uses similar principles to those described above to shift or redirect a fraction of light from a fixture to locations or in a direction other than (or in addition to) the main light output of the fixture.

These and other objects, features, aspects or advantages of the present invention will become more apparent with reference to the accompanying specification and claims.

DETAILED DESCRIPTION OF EXEMPLARY EMBODIMENTS

A. Overview

Figure 1A:
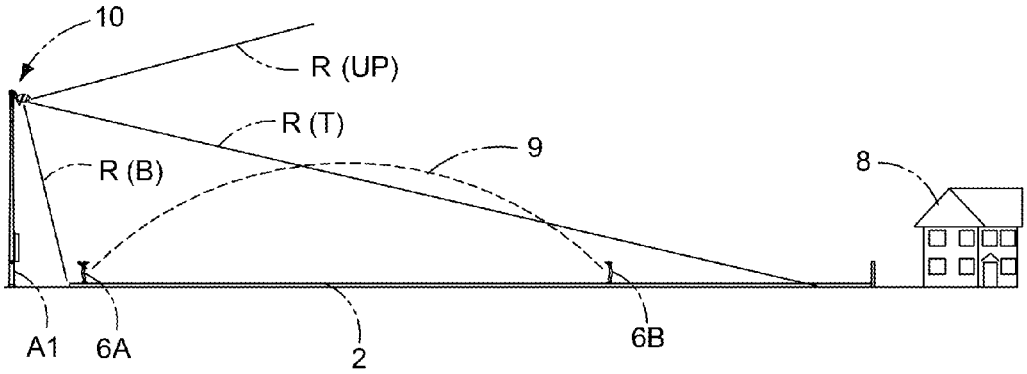
FIG. 1A is a diagrammatic side elevation illustration of an elevated wide-area lighting fixture and playability issues for typical glare and spill control lighting fixtures, and how additional up-light according to one aspect of the present invention can address such playability issues.

For a better understanding of the invention, a few examples of embodiments it could take will now be presented in detail. Frequent reference will be taken to the appended drawings. Reference numbers will be used to indicate certain parts and locations in the drawings. The same reference numbers will be used to indicate the same or similar parts or locations throughout the drawings, unless otherwise indicated.

The exemplary embodiments are designed for use with a high intensity lighting fixture 10 of the type, for example, of US publication No. 2006/0176695. Other examples can be seen at U.S. Pat. No. 4,816,974; U.S. Pat. No. 5,211,473; U.S. Pat. No. 5,161,883; U.S. Pat. No. 5,707,142; U.S. Pat. No. 6,203,176; US publication No. 2006/0198145, now U.S. Pat. No. 7,458,700; and US publication No. 2006/018175, now U.S. Pat. No. 7,789,540. Fixture 10 includes a generally bowl-shaped reflector or reflector frame 15 with an HID lamp 11 mounted inside (e.g. generally along or near its center axis). FIGS. 1, 4, 9, 10, and subparts thereof illustrate this basic combination. A glass lens 16 covers the front of reflector 15. Mounting structure 14 is connected to a bulb cone 13 and allows fixture 10 to be adjustably mounted on a cross-arm elevated on a light pole such as pole A1 of FIG. 1A. This is all conventional. Such fixtures can be commercially purchased from MUSCO® Corporation (e.g. Light-Structure Green™ brand). These types of fixtures 10 are designed to capture and control a substantial amount of light energy from lamp 11 into a controlled, concentrated beam. A plurality of fixtures 10 are elevated from different poles around field 2 (e.g. poles A1, A2, B1, B2, C1, C2, D1, D2 for a baseball field in FIGS. 2A-E) and are aimed to provide a level and uniformity of light across field 2 (usually according to certain specifications). FIG. 2A illustrates the different aiming points on field 2 for the plural fixtures 10 for each pole. It can be seen that these beams are directed to pre-designed aiming points on field 2, but which are distributed around field 2. FIG. 2B gives additional details about lighting system, including the number of fixtures, the power of lamps, and the height of the poles. It is well known in the art how to design such lighting layouts.

Figure 2A:
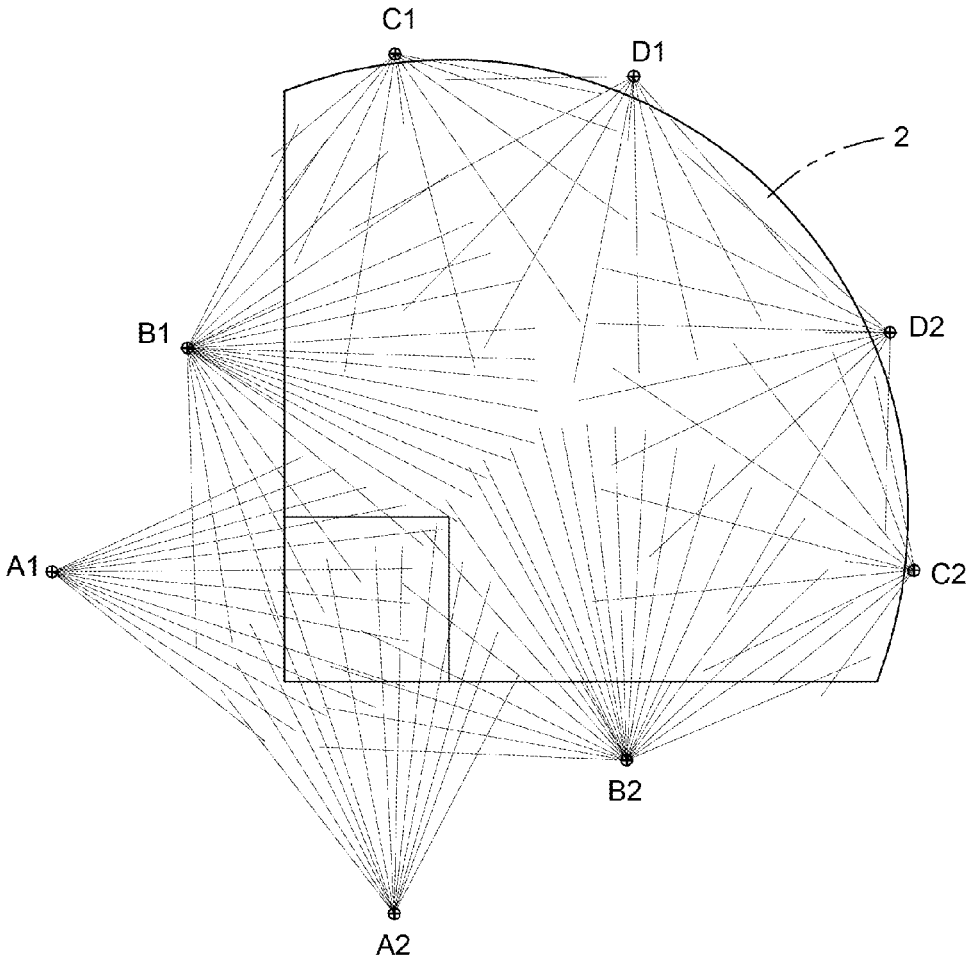
FIGS. 2A and B relate to a top plan view illustration of an exemplary sports field having eight poles, each with a plurality of lighting fixtures with different aiming directions to a sports field, to provide a specified light level and uniformity across the field.
Figure 2C:
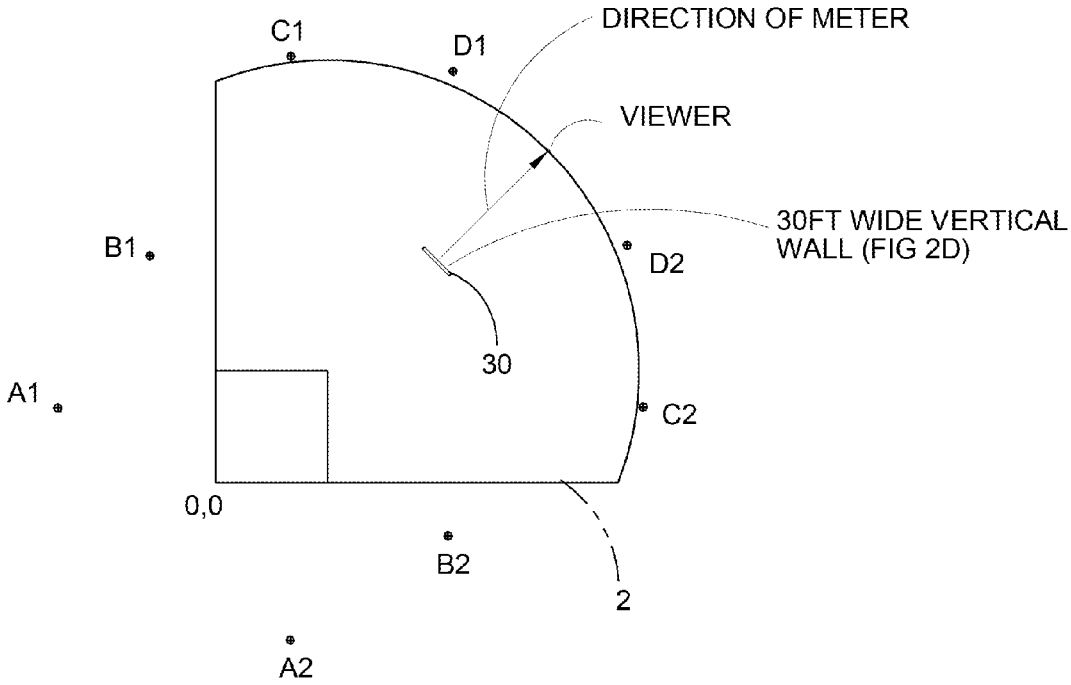
FIGS. 2C-E are diagrams which illustrate a testing methodology for measuring light levels at a plurality of elevations related to a location on the field of FIGS. 2A and B.

As illustrated in FIG. 1A, it is generally preferable to limit the amount of light that goes off of field 2. However, as described previously, even light from concentrated, controlled beams disperses over distance. Therefore, some lighting systems utilized glare and spill light control methods to keep light from going off the field and, for example, reaching a house 8 (FIG. 1A) near field 2. To do this the upper limit of the beam from the lighting fixture (see reference R(T) of FIG. 1A) must be controlled so that it does not reach house 8. But, as illustrated in FIG. 1A, a baseball that is hit above line R(T) may travel above that upper limit of the beam and may be hard to see.

B. General Example

Therefore, the general solution of the exemplary embodiments according to the present invention takes the following approach.

Figure 8A:
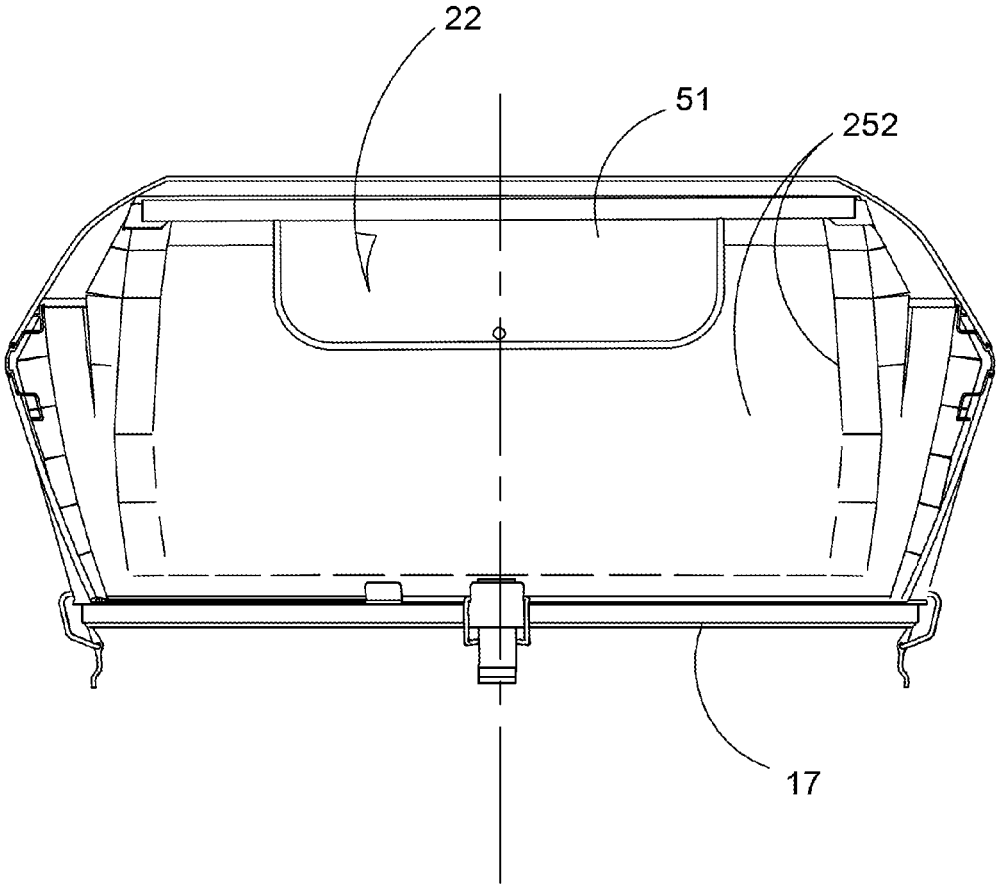
FIGS. 8A-E are perspective and orthographic views of the completed assembly of the visor of FIGS. 4A-E.
Figure 8B:
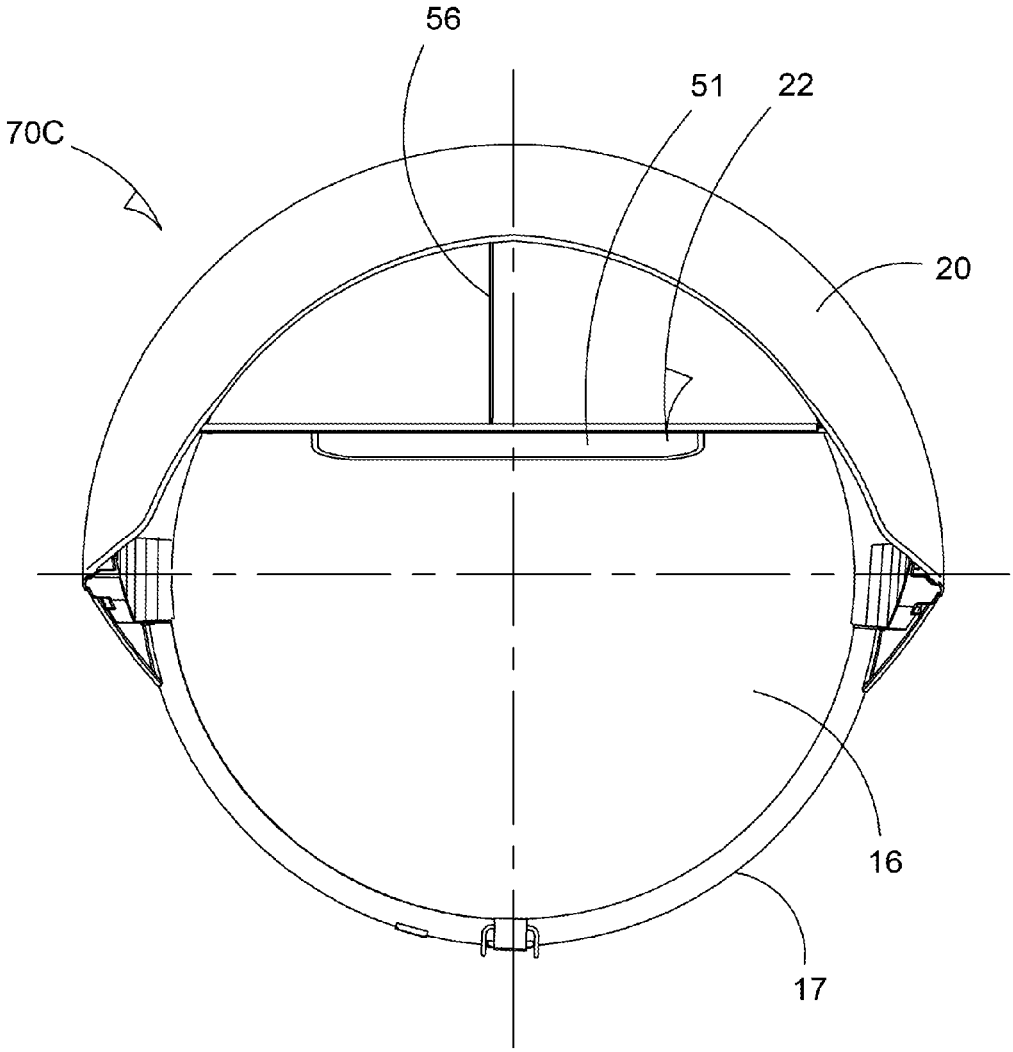
Figure 8C:
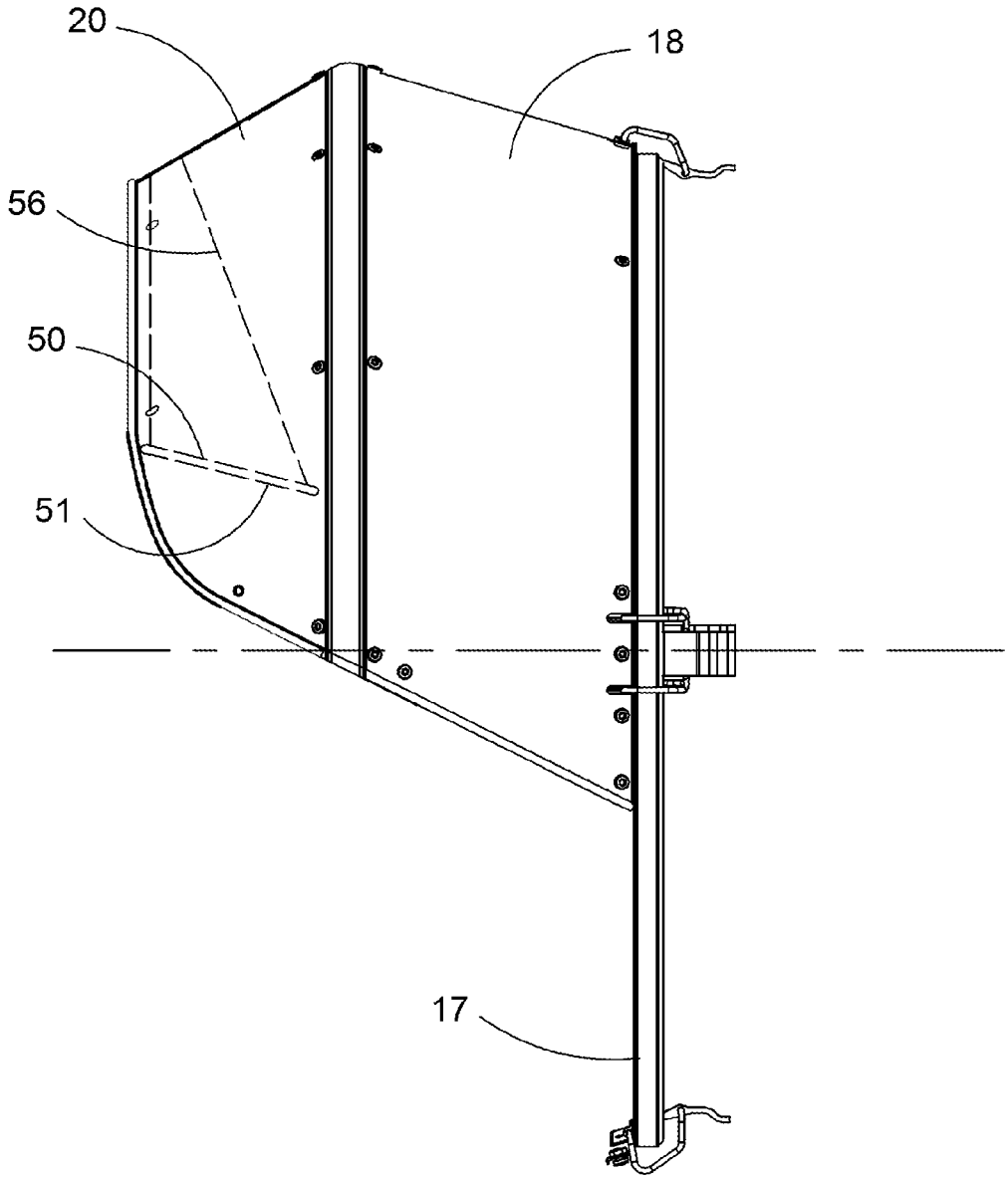
Figure 8D:
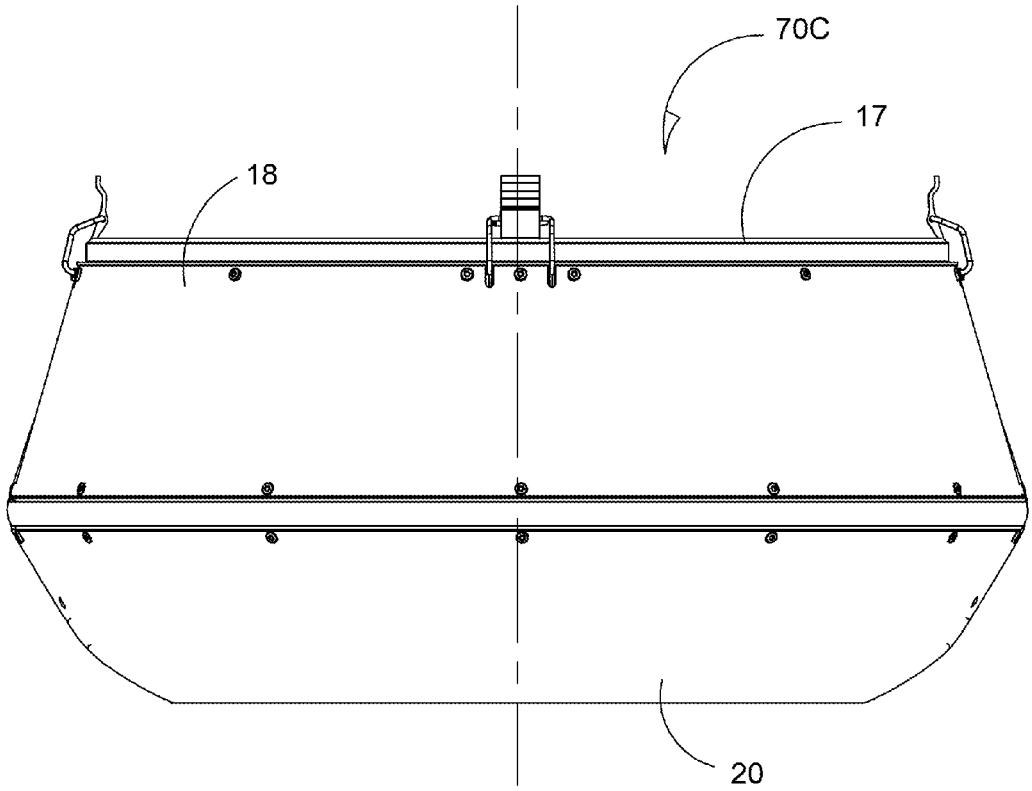
Figure 8E:
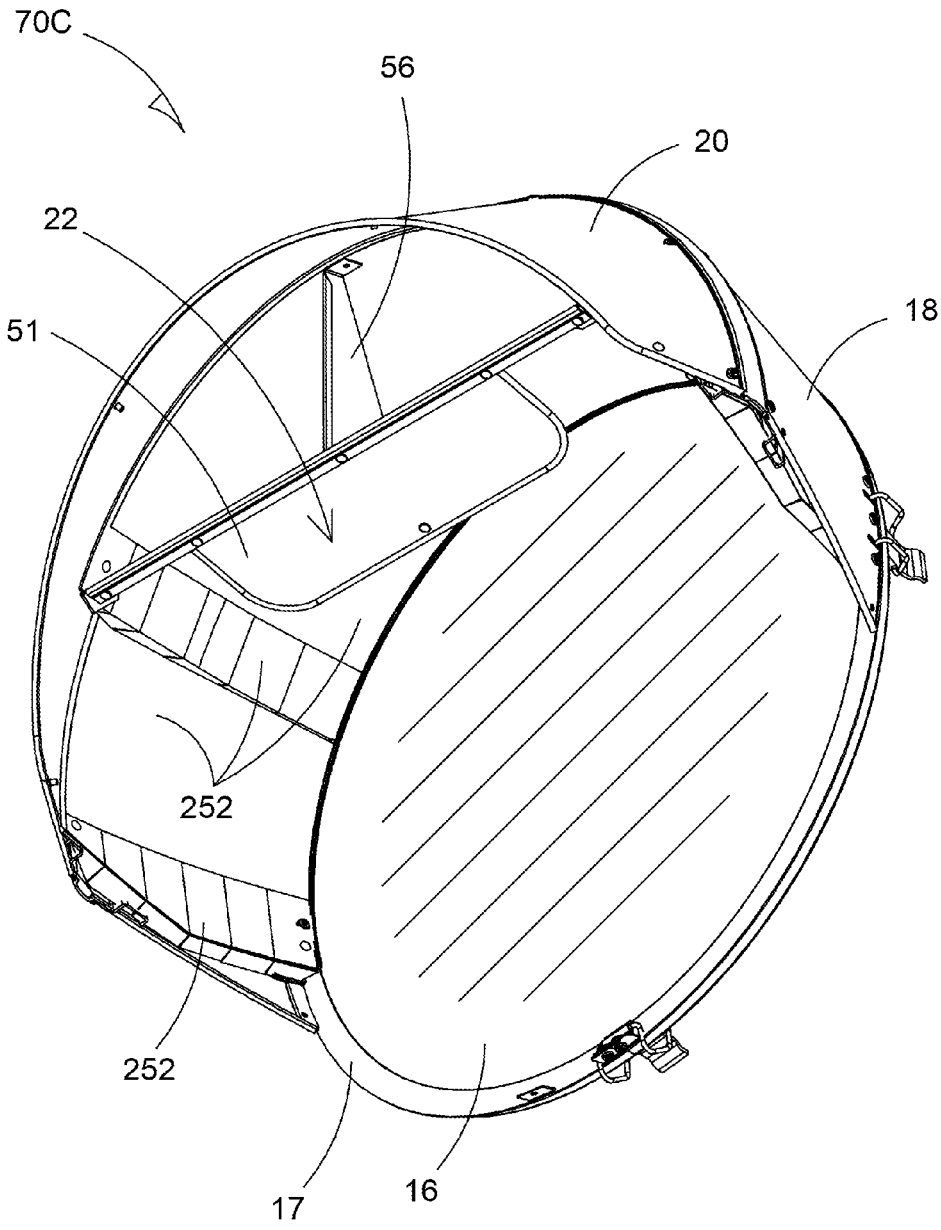
Figure 9A:
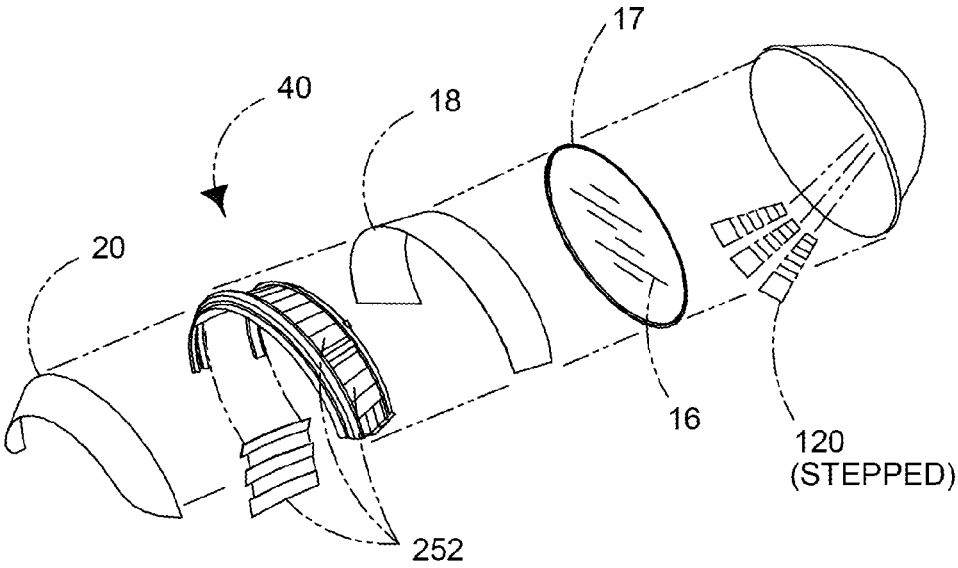
FIGS. 9A-E are perspective fully exploded, perspective partially exploded, perspective assembled, side elevation, and perspective comparison views, respectively, of a Second Example according to an alternative exemplary embodiment of the present invention.
Figure 9B:
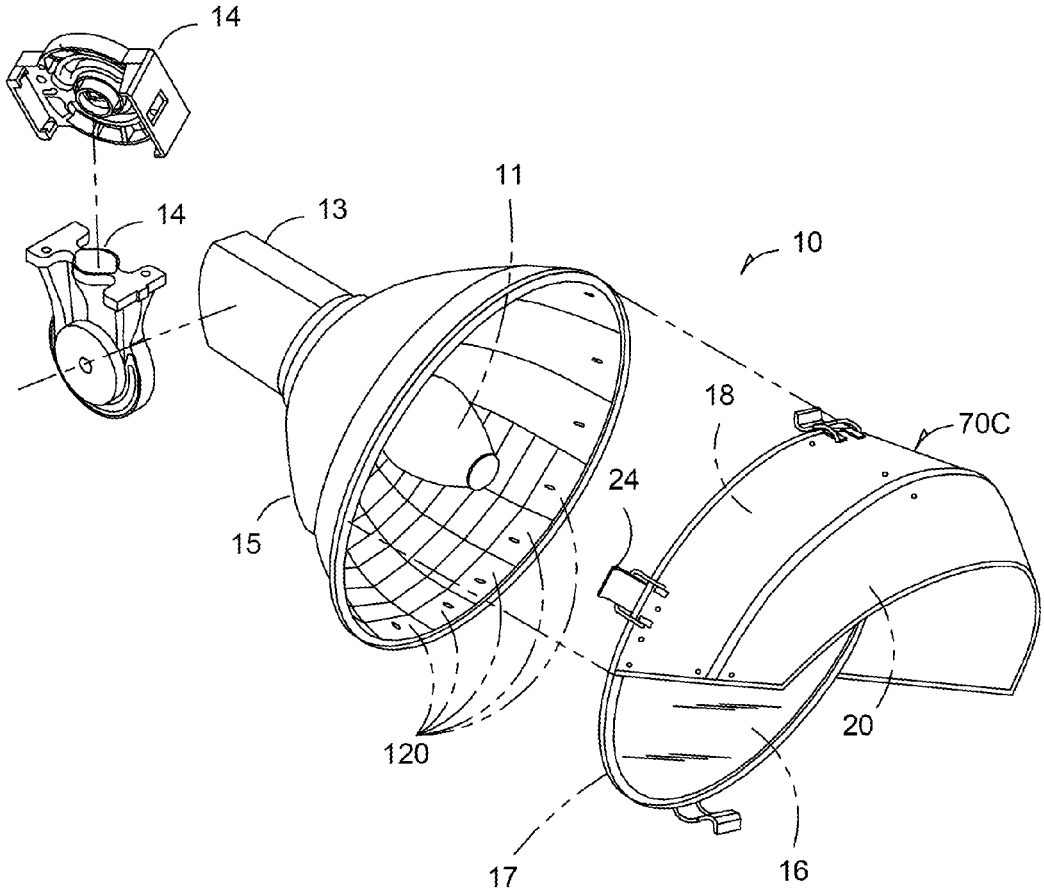
Figure 9C:
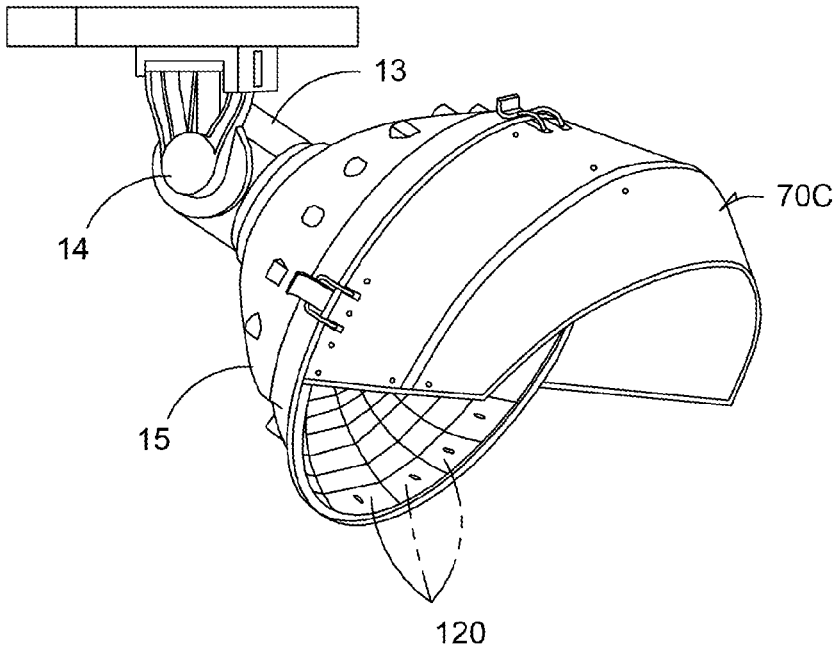

First, instead of a relatively long visor, a relatively short visor is utilized on fixture 10. This is contrary to conventional glare and spill control techniques. As shown in the Figures, the visor extends outward from the perimeter of the face of reflector or reflector frame 15. The visor 70C of the present application can be similar to visors 70A and B of incorporated by reference US publication No. 2006/0181882 (see FIGS. 8A and 9A respectively), but is shortened at its front relative to either of those. Visor 70C is shortened at its distal portion a few inches relative to visor 70A of US publication No. 2006/0181882 (FIG. 8A). Visor 70C is shortened close to a foot (12 inches) relative to visor 70B of US publication No. 2006/0181882 (FIG. 9A). Therefore, visor 70C of the present exemplary embodiment is relatively short in comparison to those visors. Visor 70C does tend to block less light from the bottom hemisphere of reflector 15 than the longer visors and block less direct views of its light source or reflector surface, but, at normal aiming angles for light fixtures 10, allows some direct light to travel upward for aerial illumination.

Second, for fixtures 10 of the relative (and conventional) size of reflector 15 and light sources as indicated in FIG. 2B, relatively short visor 70C provides a reasonable amount of spill light control and glare control. As discussed above, by shortening visor 70C from those of 70A and B of US publication No. 2006/0181882, as examples, some glare and spill control may be sacrificed. However, the amount of shortening of visor 70C is designed to still provide a reasonable amount of glare and spill control and also to achieve some direct up-light. The drawings of visors 70C in the present application, and visors 70A and B in the incorporated by reference applications, are intended to and do give a good approximation of the relative size, shape, and proportion of each of those visors to the reflector or reflector frame 15, and the other components of their respective light fixtures. As can be seen and appreciated by those skilled in the art, the designer can, through empirical testing, select a size and shape of visor 70C to produce an acceptable amount of glare and spill control for an application and, at the same time, allow a relatively small but sufficient percentage of light to pass by the front distal edge of visor 70C for use as up-light.

Third, like visors 70A or B of US publication No. 2006/0181882, a highly reflective surface is added to the interior of the visor 70C. The surface is configured to capture and control incident light from the light source to the target. Therefore, reduction in efficiency of the fixture relative the target is reduced or minimized. Light incident on the visor is not simply blocked or absorbed, or redirected with an inefficient or difficult to control surface. This helps not only in efficiency of the fixture but in glare and spill control. Generally, it is easier to control glare and spill if the direction of light can be controlled.

Therefore, the general concept of fixture 10 according to the exemplary embodiments is to (a) configure and use a visor that might be less consistent with a high levels of glare and spill control by intentionally allowing a relatively small but sufficient amount of direct light generated from the fixture to pass as up-light, but (b) do so in a manner that promotes efficiency of the fixture with a reasonable amount of relatively controlled glare and spill control. As illustrated at FIG. 1A, allowing a relatively small amount of light from a fixture to pass upward as up-light can provide sufficient light for aerial viewing but use of the visor and highly reflective visor surfaces can still allow a substantial and reasonable amount of glare and spill control.

This can be accomplished by a variety of apparatus and methods. A few non-limiting examples will be described below.

C. Specific Example Apparatus 1

Figure 1B:
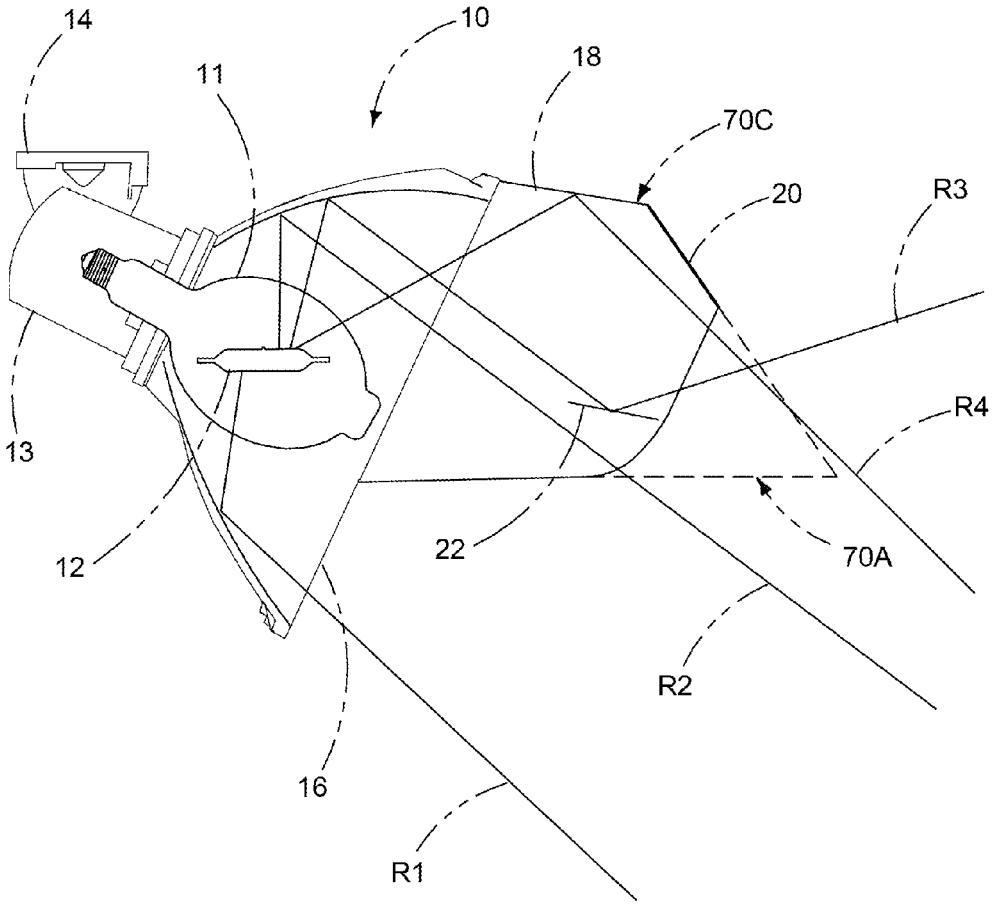
FIG. 1B is an enlarged diagrammatic side view of a lighting fixture according to one exemplary embodiment of the present invention, and also contrasting how up-light is allowed by the shortened visor and louver of the exemplary embodiment compared to a longer visor.
Figure 1C:
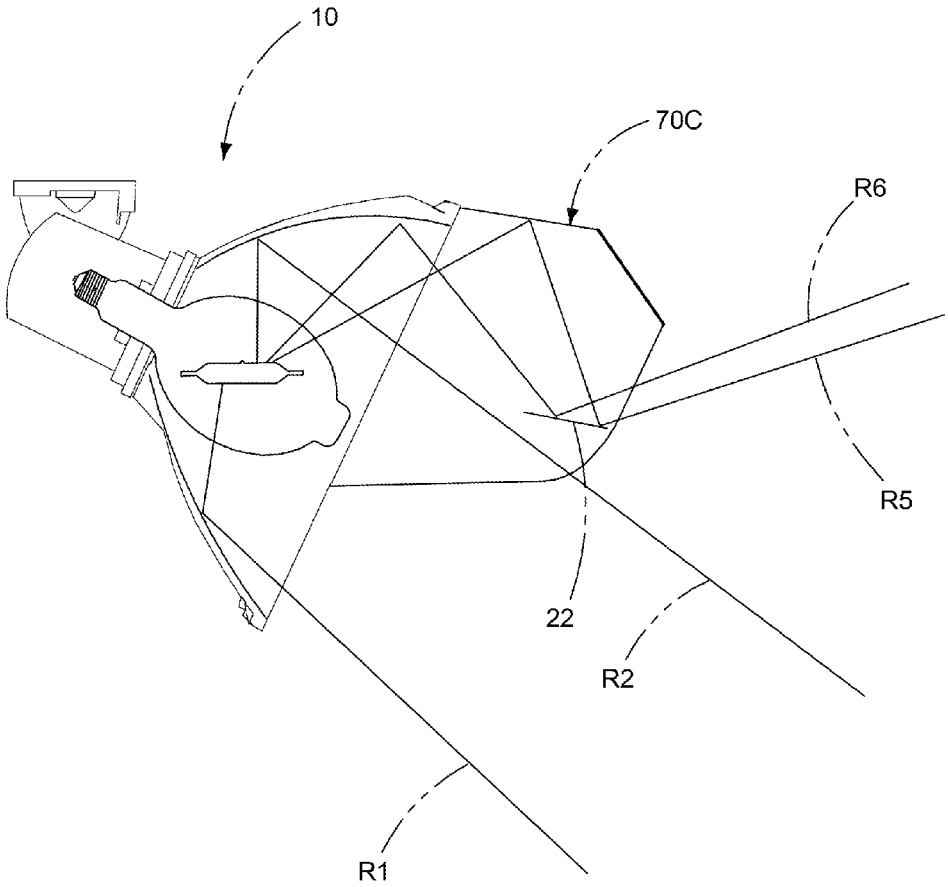
FIG. 1C is similar to FIG. 1B but diagrammatically shows the exemplary embodiment of FIG. 1B and how it produces up-light.

A first exemplary embodiment of the present invention is designed to direct a controlled amount of light upward for aerial viewing, but also provide glare and spill control, all without significant impact to the target. Exemplary embodiment 1 is normally the preferred method as it provides the added benefit of more precise control of the amount and direction of up-light along with very consistent levels of up-light for aerial viewing in comparison with the second and third exemplary embodiments described later. It is to be understood, however, that other embodiments and configurations of the invention are possible. FIGS. 1A-C diagrammatically illustrate the basic concepts of exemplary embodiment 1. FIGS. 4A-E, 5A-E, 6A-E, 7A-C, and 8A-E show details of one way to build exemplary embodiment 1.

First, visor 70C is added to conventional fixture 10. As discussed above, it is somewhat shorter in length than most conventional glare and spill control visors relative to the size and beam produced by the fixture.

Second, a louver assembly 22 is mounted in visor 70C. It is designed to take some light reflected from reflector 15 of fixture 10 that otherwise would be a part of the beam of fixture 10 aimed to field 2, and redirect it upwardly to add up-light.

Figure 6A:
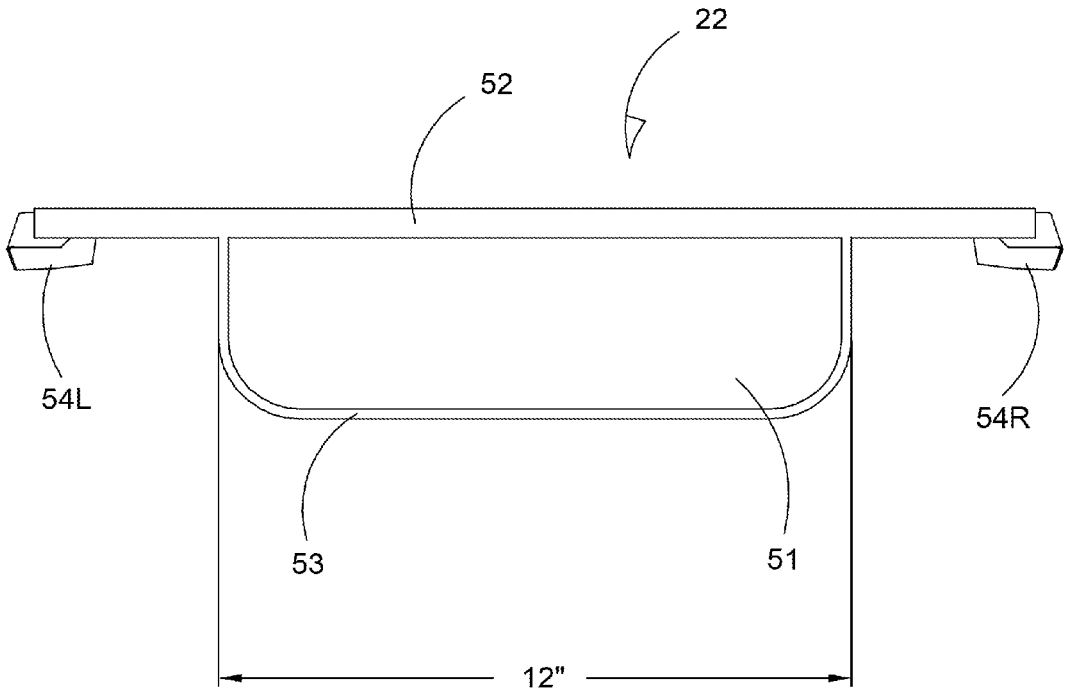
FIGS. 6A-E are perspective and orthographic views of the louver sub-assembly of FIGS. 5A-E.
Figure 6B:
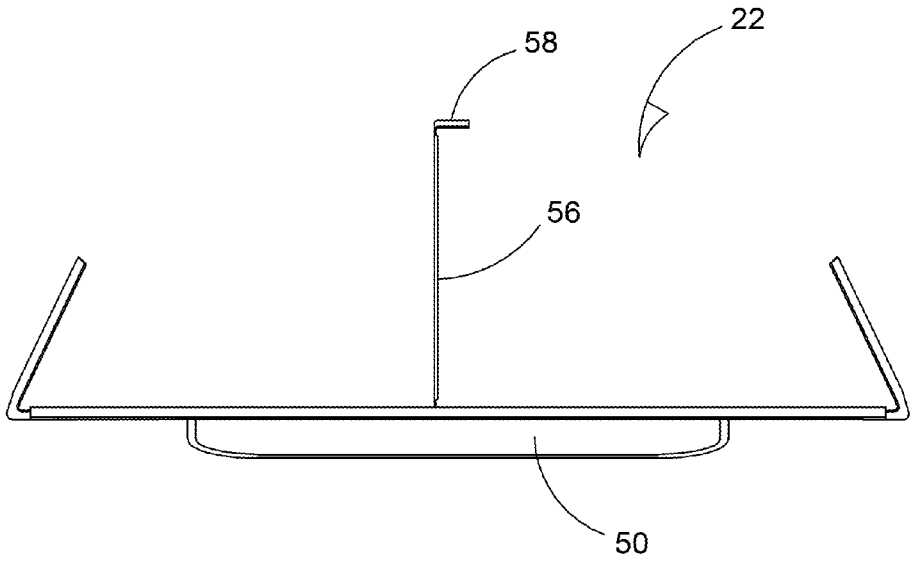
Figure 6C:
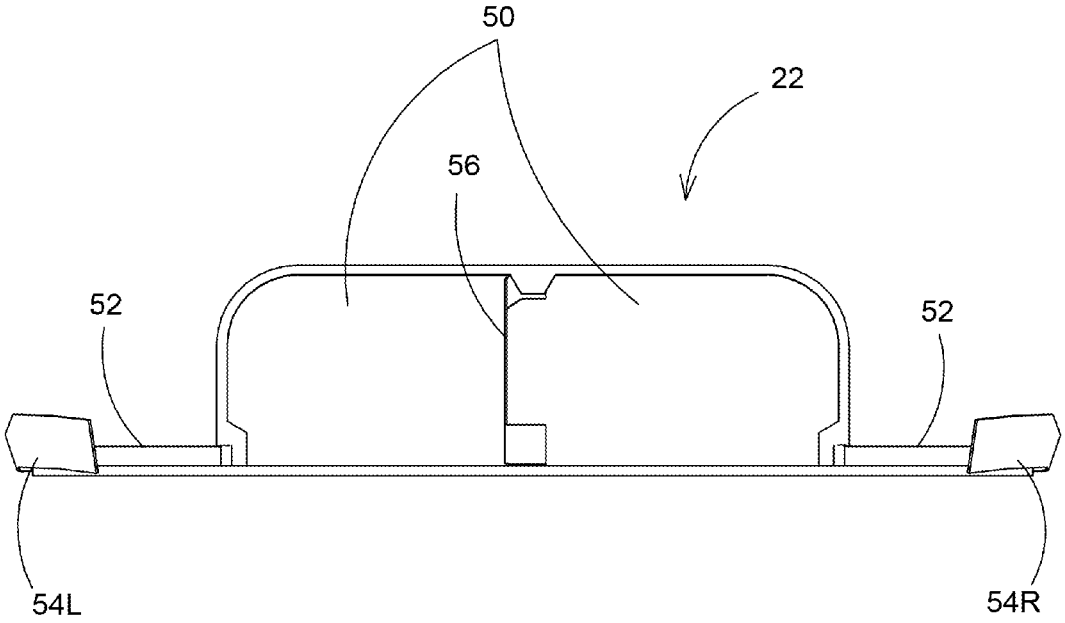

Louver assembly 22 has a highly reflective surface or plate 50 on its upper side (see FIGS. 6A-C). This is illustrated diagrammatically by ray R3 in FIG. 1B. It is to be understood that light would hit surface 50 of louver assembly 22 from a variety of angles and thus create essentially a rectangular pattern or beam directed outwardly and upwardly for up-lighting (see diagrammatic illustration of the beam pattern at FIG. 11). For example, as shown in FIG. 1B, ray R3 originated in arc tube 12, is reflected first from the middle of the upper part of reflector 15, and is then reflected from the top of louver assembly 22. FIG. 1C shows examples of two different rays R6 and R5, which also originate in arc tube 12 but reflect from nearer the front of reflector 15 and from the inside of visor 70C, respectively, and then are reflected from the top of louver assembly 22. The different angles of incidence of rays R3, R5, and R6 would result in different angles of reflection from louver assembly 22. However, the size, shape, reflectivity, and angle of louver assembly 22 is designed to take only a fraction of light energy from the beam of fixture 10 to use for up-lighting at heights above field 2 that are above the normal tops of beams from conventional fixtures. This redirected light from louver assembly 22 is not blocked because the distal part 20 of visor 70C is intentionally shorter and allows it to pass upwardly. For comparison, a more conventional length for a glare and spill visor is shown by dashed line 70A in FIG. 1B (e.g. similar to the visor 70A of FIGS. 7B and 8A of US publication No. 2006/0181882). The longer visor would block ray R3. A still longer visor (e.g. the visor of FIGS. 6A and B and 9A of US publication No. 2006/0181882) would block even more light from traveling up. As illustrated in FIG. 1A of the present application, the additional up-light of fixture 10 with visor 70C and louver assembly 22 would provide up-light above ray R(T) (indicated by the area between ray R(T) and R(UP)), and provide up-light illumination of a baseball following trajectory 9.

Third, high reflectivity inserts 252 are added to the interior of visor 70C. Inserts 252 can be designed to have different reflecting characteristics. Note that in FIGS. 5A-E and 8A-E, only a few inserts 252 are shown in some of the views. They normally are mounted side-by-side across the interior of visor 70C. These inserts 252 can be similar to or the same as those shown and described in US publication No. 2006/0176695. See also US publication No. 2006/0181882; and US publication No. 2006/0181875, now U.S. Pat. No. 7,789,540. The highly reflective surface can be multiple pieces or strips of high reflectivity material like that disclosed in US publication No. 2006/0181882; US publication No. 2006/0181875; and U.S. Pat. No. 6,203,176 (see also inserts 252 of US publication No. 2006/0176695). Alternatively, larger or even a single shaped piece can be used. The high reflectivity inserts 252 provide the ability to better control light to the target, for both efficiency of the fixture and control of spill and glare. Without such precisely and highly reflective inserts, light would tend to either by blocked and absorbed, or reflected in less controllable fashion. This can result in more light off the field (spill) and more glare.

It should be understood that visor 70C of exemplary embodiment 1 addresses objects of the invention by (a) intentionally creating some up-light while at the same time (b) providing some spill and glare control. It is designed to redirect or allow an amount of light energy to go upwardly for up-lighting purposes, but only an amount sufficient for the limited needs of up-lighting, while maintaining a reasonable or sufficient amount of spill and glare control and, additionally, without taking too much light away from the target, namely field 2. By empirical testing, the size, shape, position, and reflective characteristics for different amounts and characteristics of up-light can be derived. The designer can then select the amount and characteristics of up-light for aerial viewing needed or desired. As a general rule, the designer will divert only enough light from the fixture for up-lighting to meet minimum needs to preserve as much light as possible for direction to the target, and to minimize glare, spill, or halo effect light.

As can be appreciated, FIGS. 1A-C illustrate the general principle for one lighting fixture. As indicated in the example of FIGS. 2A-D, field 2 has over 100 fixtures. Taking a bit of light energy from each beam and creating up-light at the levels indicated in FIGS. 3C-E, for example, does not detrimentally reduce the amount of light to field 2 (perhaps on the order of a few percent, such as no more than about 5%). Also, using visor 70C, even though shortened, maintains a reasonable amount of glare and spill control.

FIG. 4 of US publication No. 2006/0176695 shows the basic components of sports lighting fixture 10 in exploded form, but with a more conventional, longer visor 70A (referred to as the seven inch version). FIG. 5A of US publication No. 2006/0176695 shows it in assembled perspective form. FIGS. 6A and B of US publication No. 2006/0176695 show an even longer visor 70B (referred to as the fourteen inch version). US publication No. 2006/0176695 can be referred to regarding general details about such visors and light fixture. There are many similarities between them and the fixture 10 and visor 70C of this exemplary embodiment.

FIGS. 4A-E, 5A-E, 6A-E, 7A-C, and 8A-E of the present application illustrate details regarding visor 70C of the exemplary embodiment 1 of the present invention, which is used in place of visor 70A or 70B, FIGS. 5A-5B or FIGS. 6A-6B of US publication No. 2006/0176695. The main construction of visor 70C is similar to visor 70A with only a few variations.

Figure 4A:
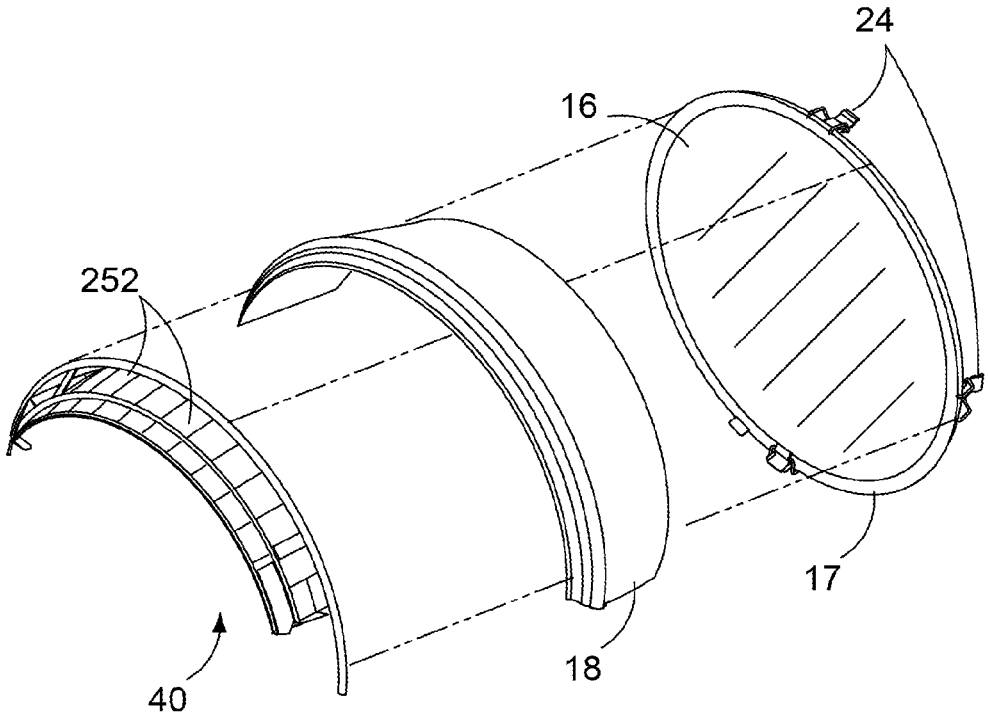
FIGS. 4A-E are perspective views of various stages of assembly of Example 1 of the Detailed Description.
Figure 4B:
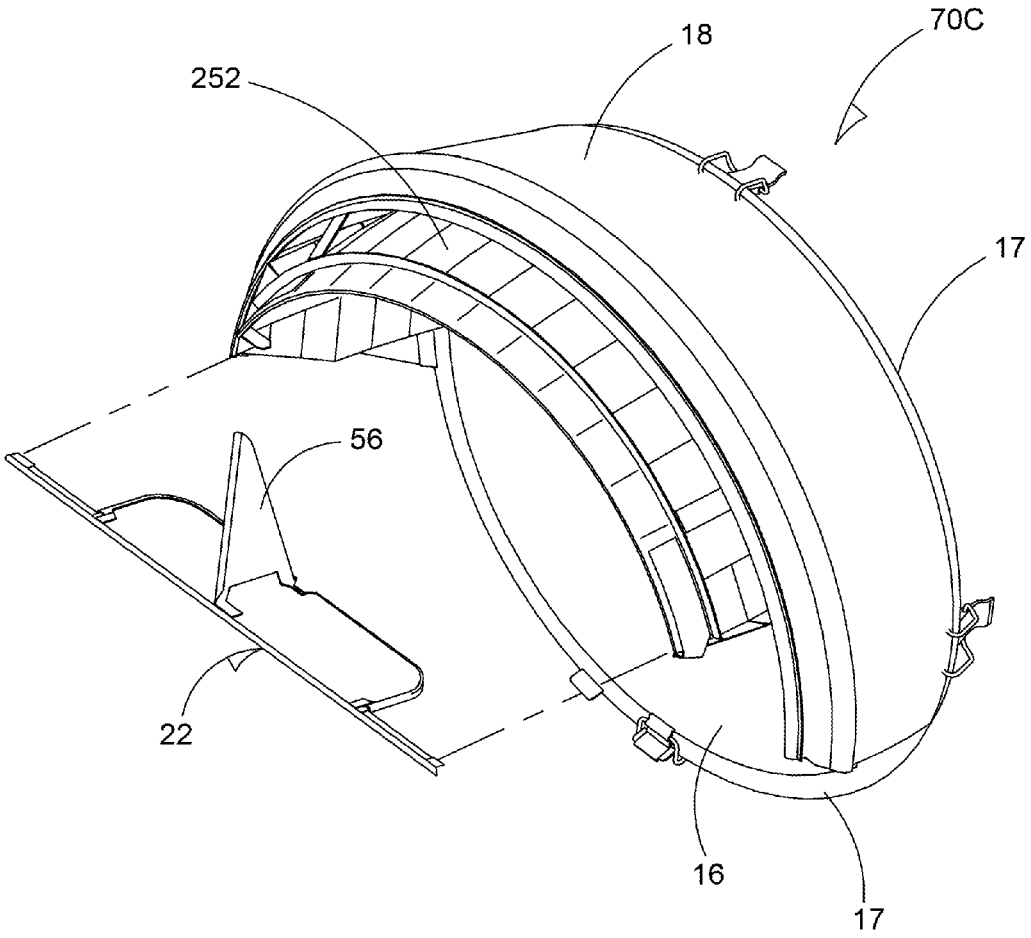
Figure 4C:
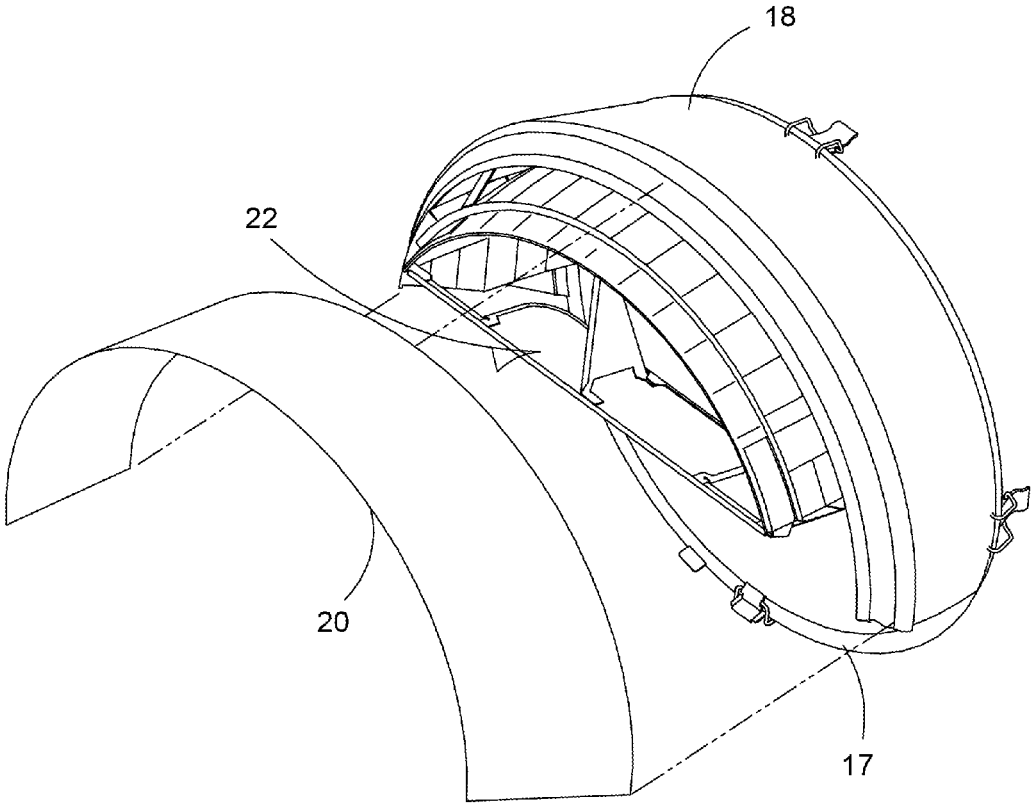
Figure 4D:
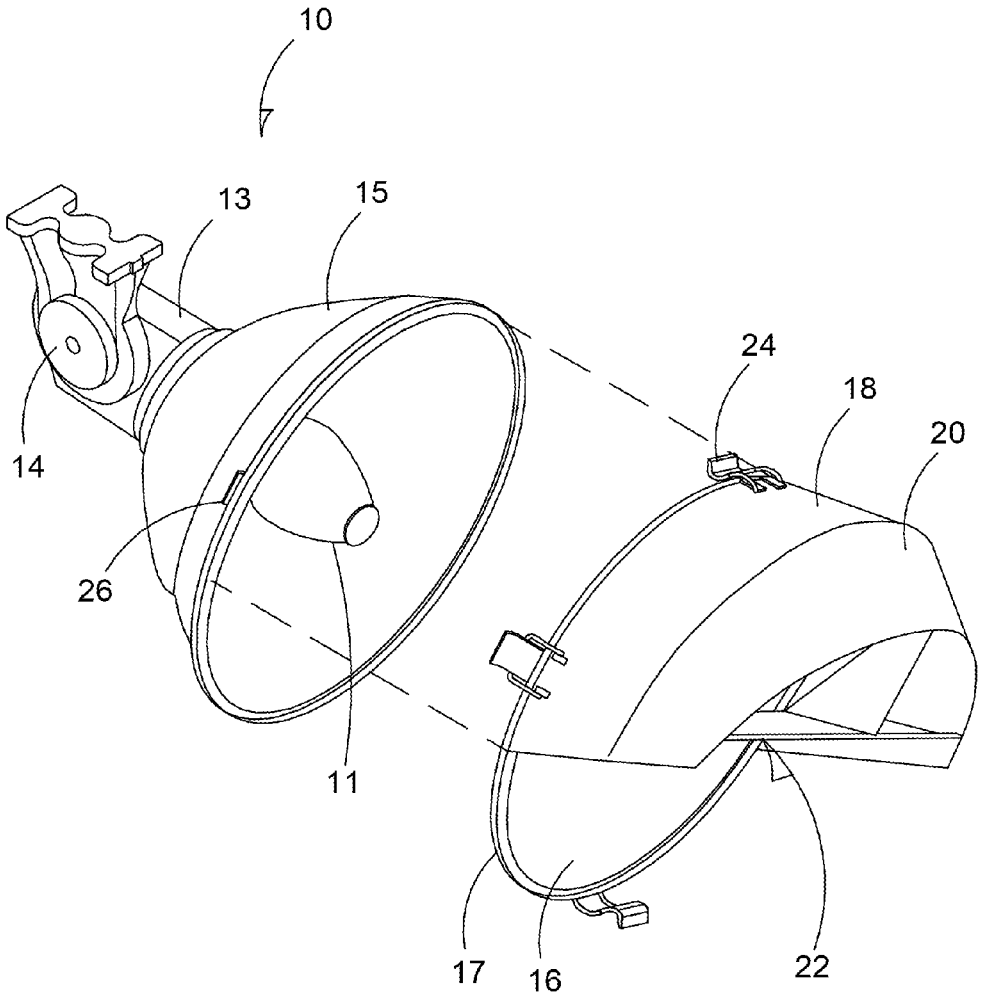
Figure 4E:
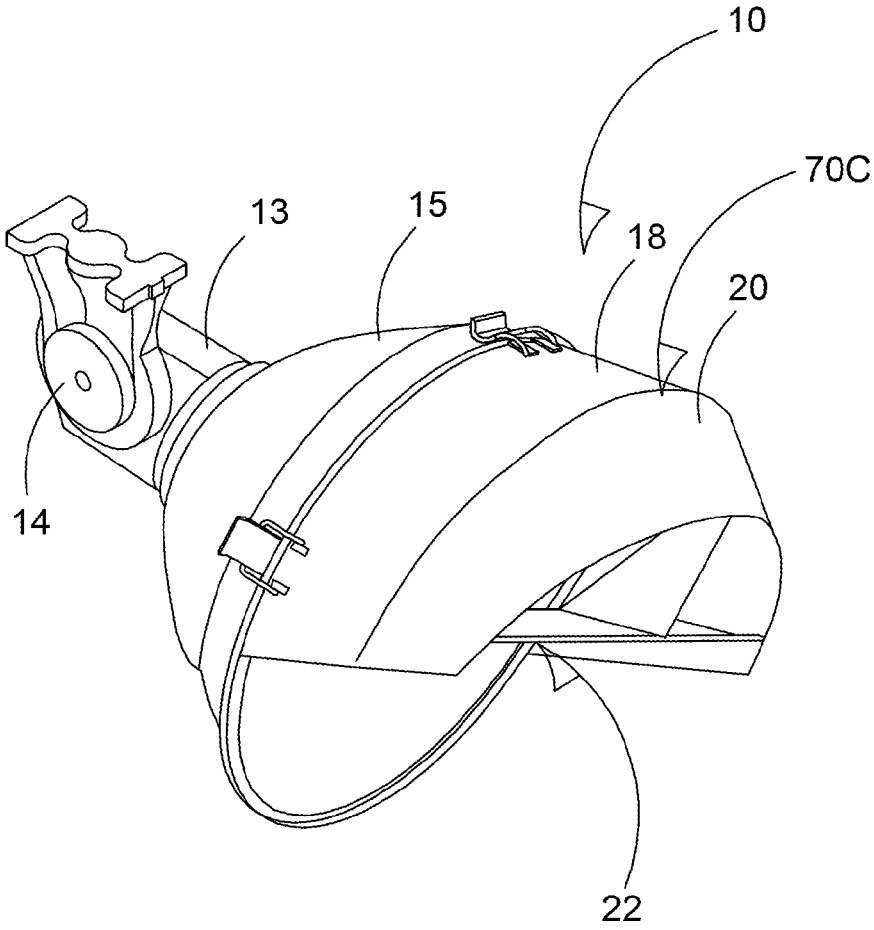
Figure 5A:
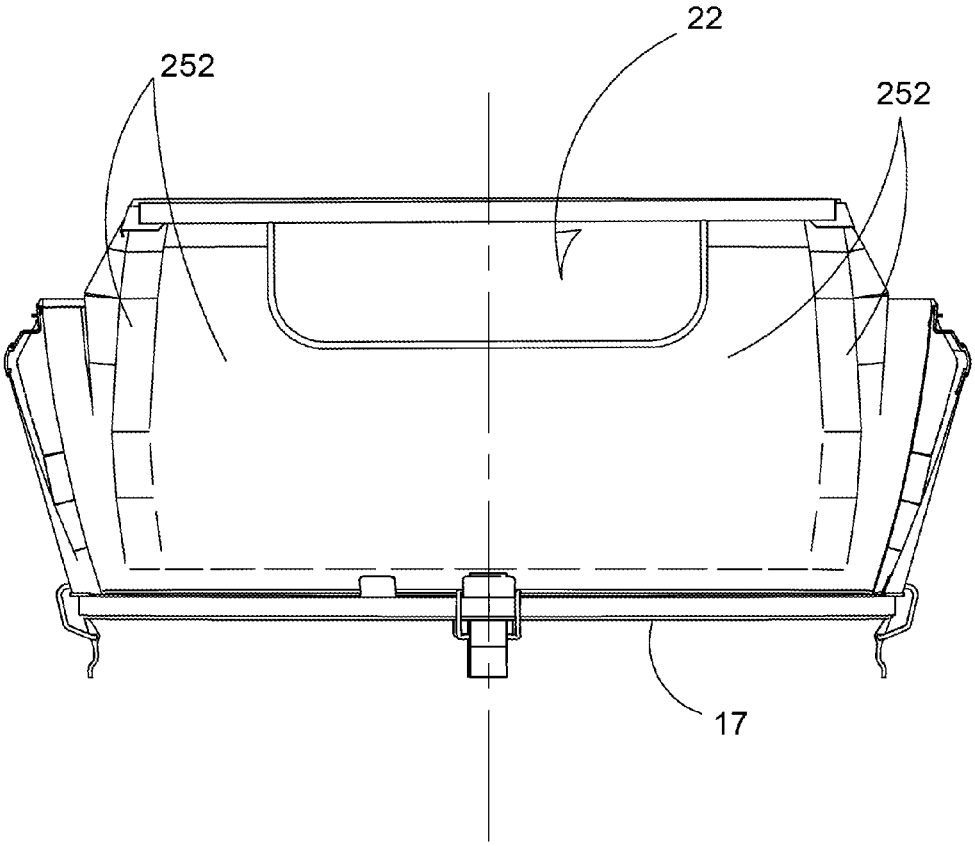
FIGS. 5A-E are perspective and orthographic views of the base visor sub-assembly with louver of FIGS. 4A-E.
Figure 5B:
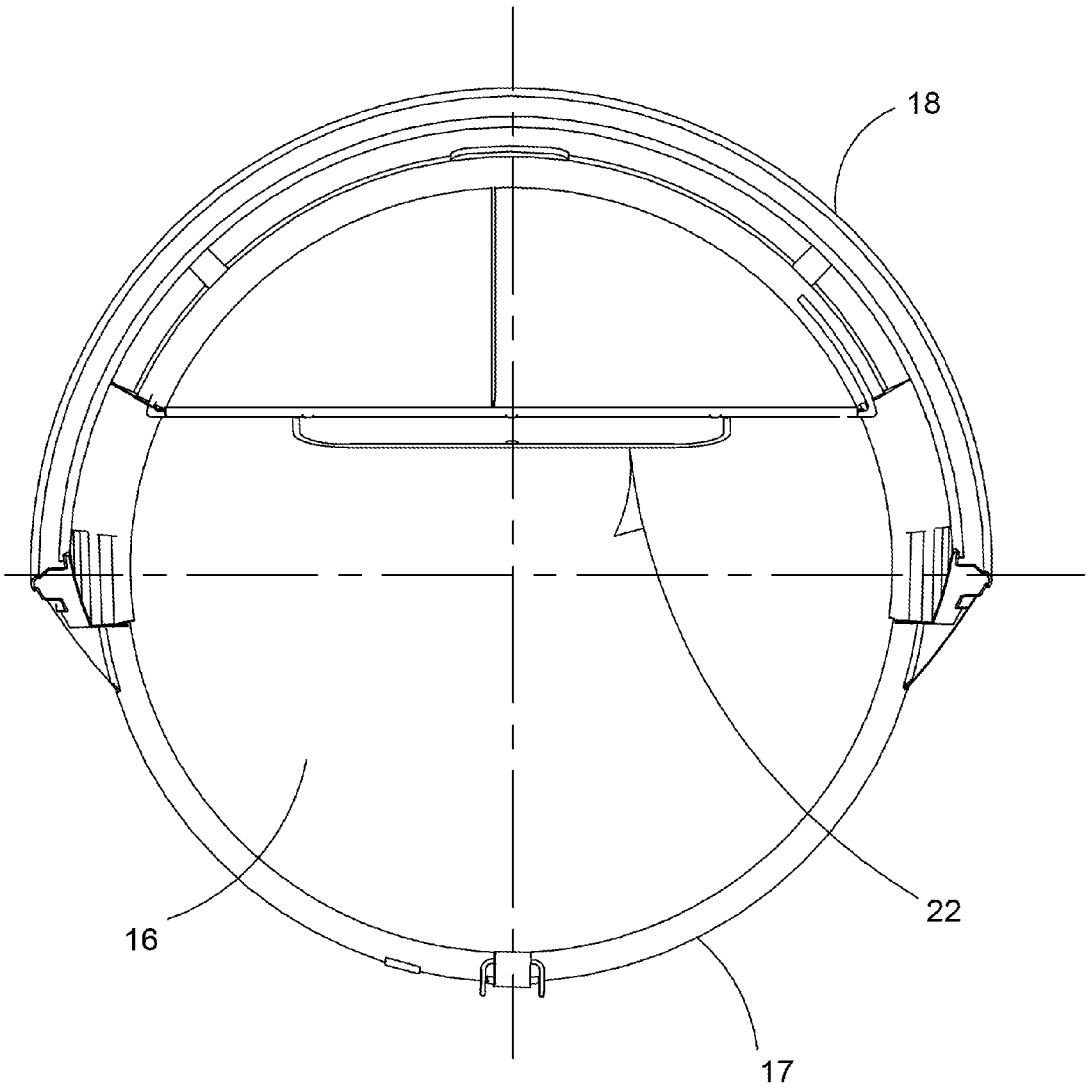
Figure 5C:
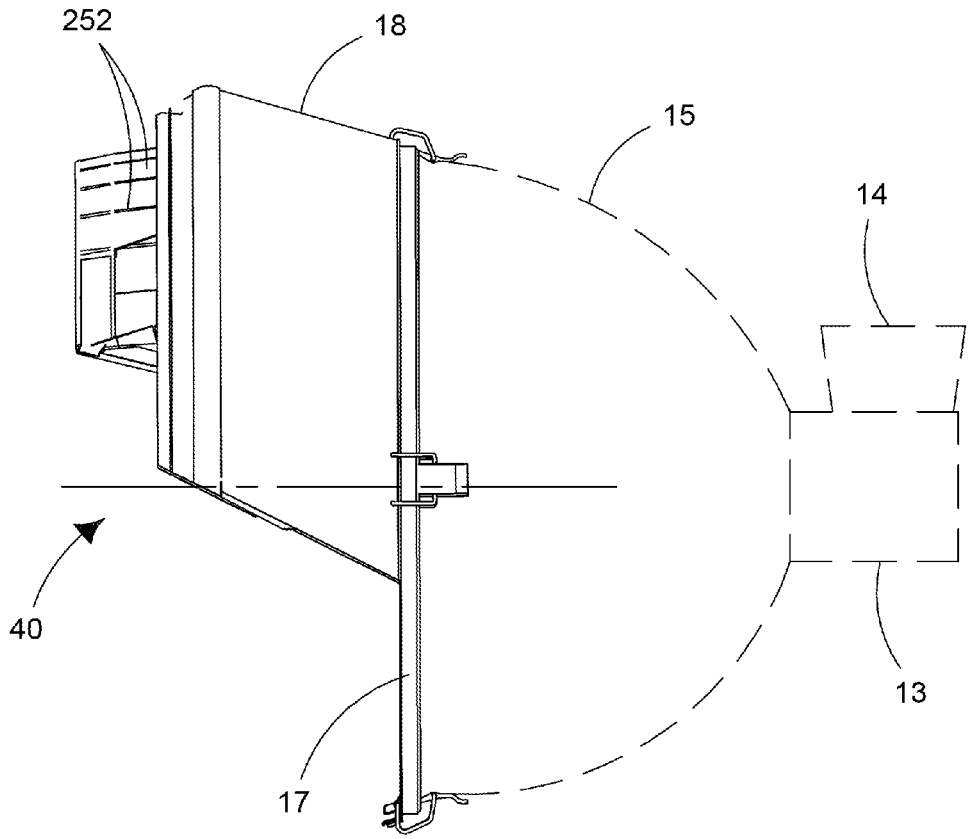
Figure 5D:
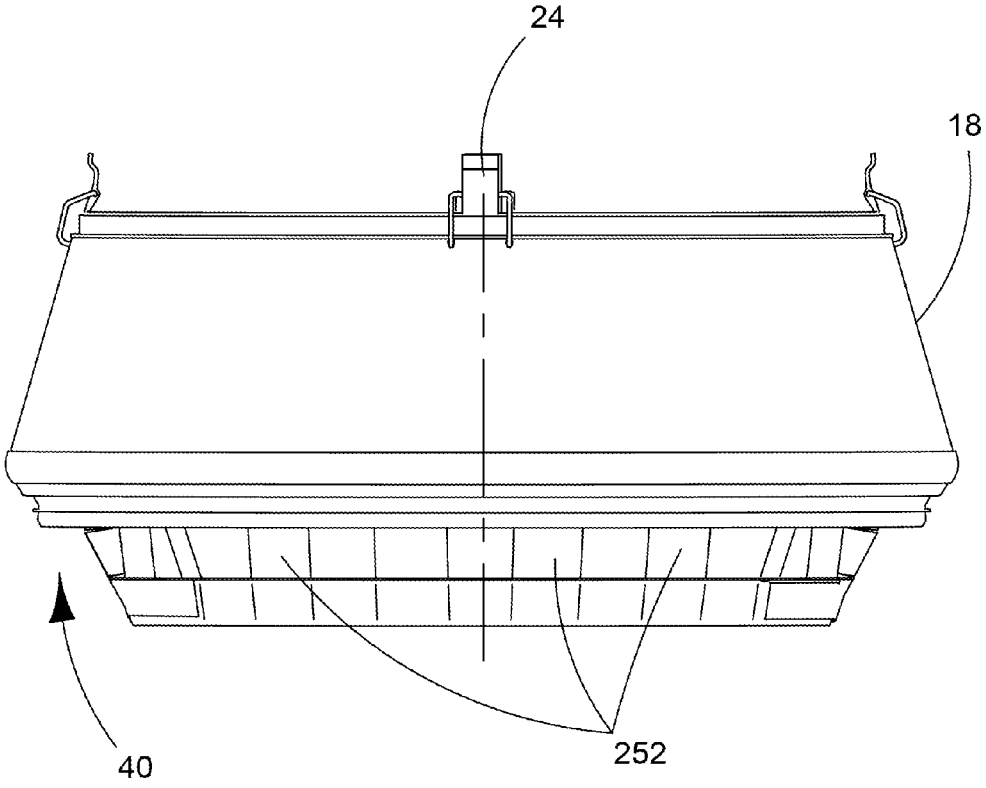

As can be seen in FIGS. 4A-D and 5A-E, visor 70C includes a lens rim 17 (in which is contained a glass lens 16) with latches 24 to latch to latch receivers 26 on a reflector 15. Visor 70C also includes a base visor shell 18 attached to lens rim 17 and what will be called visor frame 40, which is attached to base visor shell 18 and extends outwardly. Details can be seen in US publication No. 2006/0176695. As illustrated in FIG. 4A, highly reflective strips 252 are mounted on visor frame 40. Distal visor shell 20 is mounted to and extends outwardly and somewhat downwardly from the outer end of visor frame 40. US publication No. 2006/0176695 describes ways strips 252 can be mounted as well as details of visor frame 40. U.S. Pat. No. 6,023,176 discusses different types of highly reflective inserts.

Figure 6D:
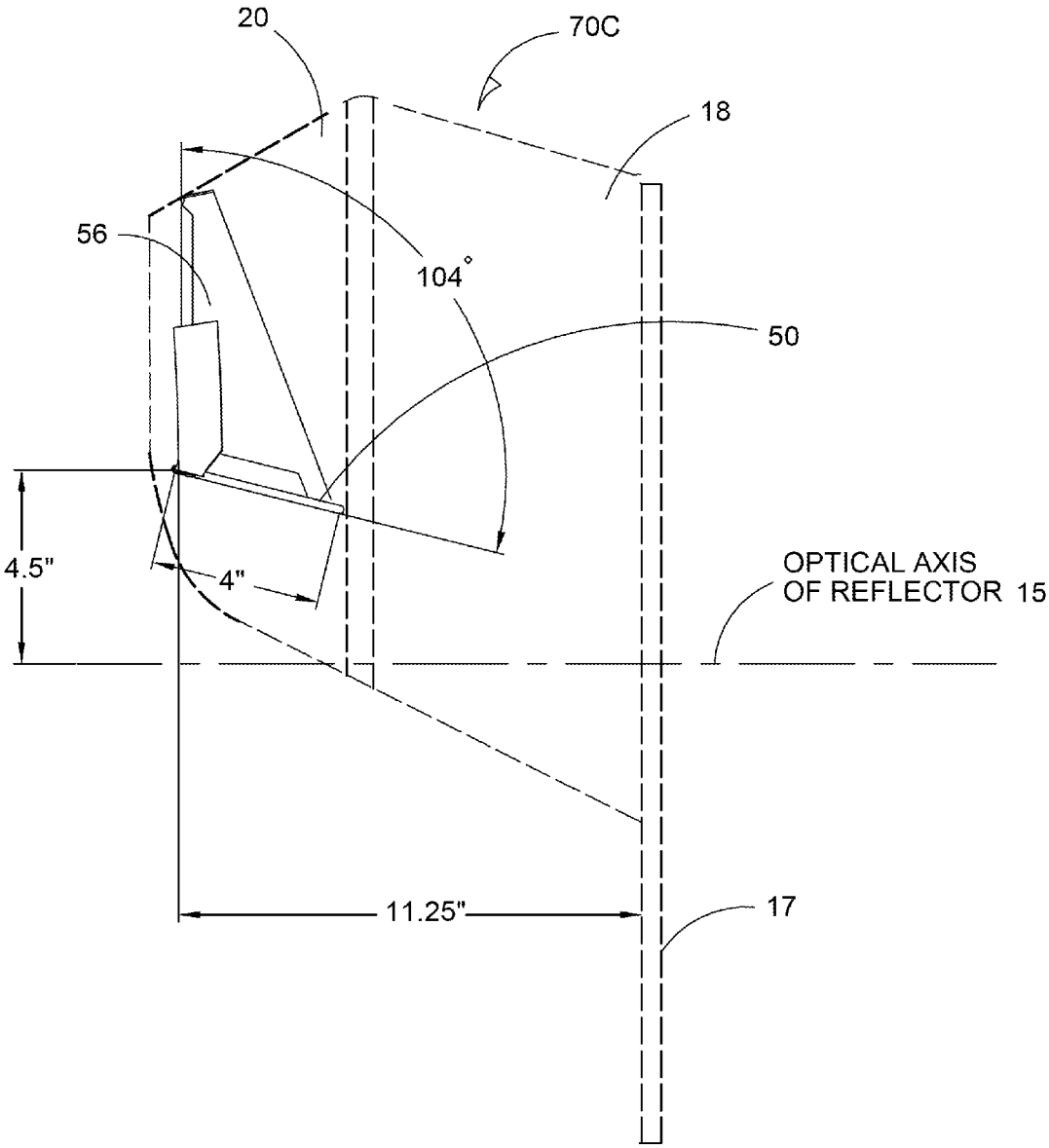
Figure 6E:
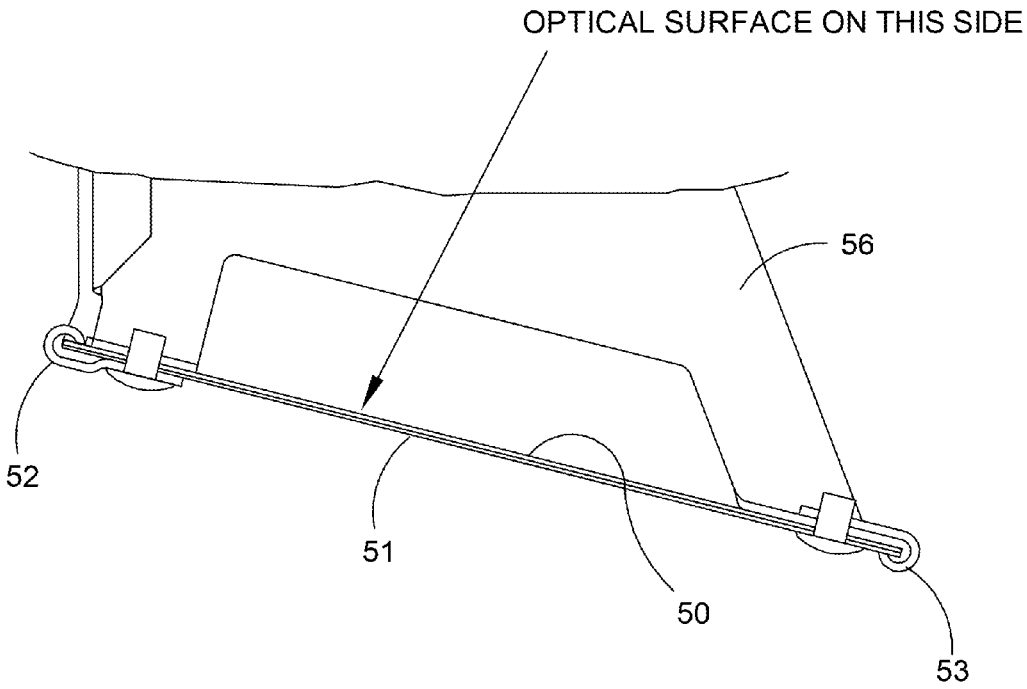
Figure 7A:
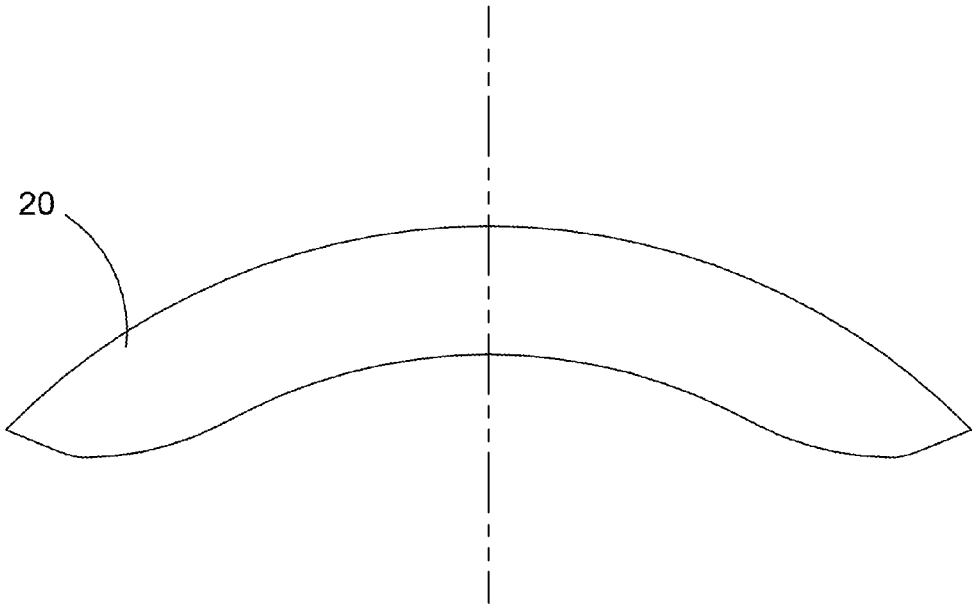
FIGS. 7A-C are flattened (FIG. 7A) and shaped (FIGS. 7B and C) views of the distal visor section of FIGS. 4A-E.
Figure 7B:
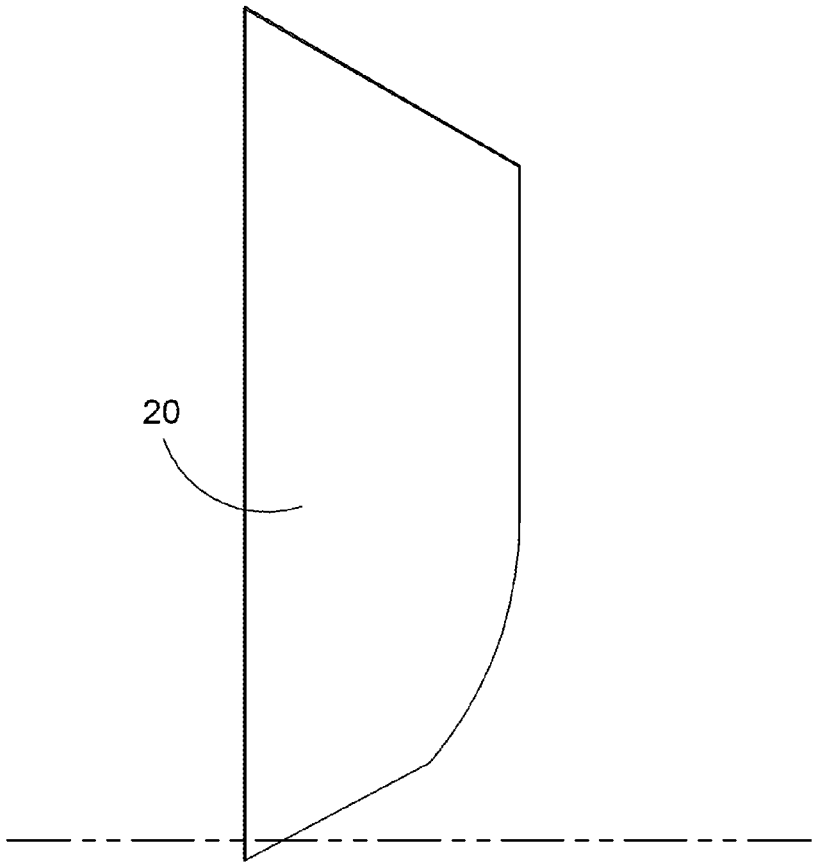
Figure 7C:
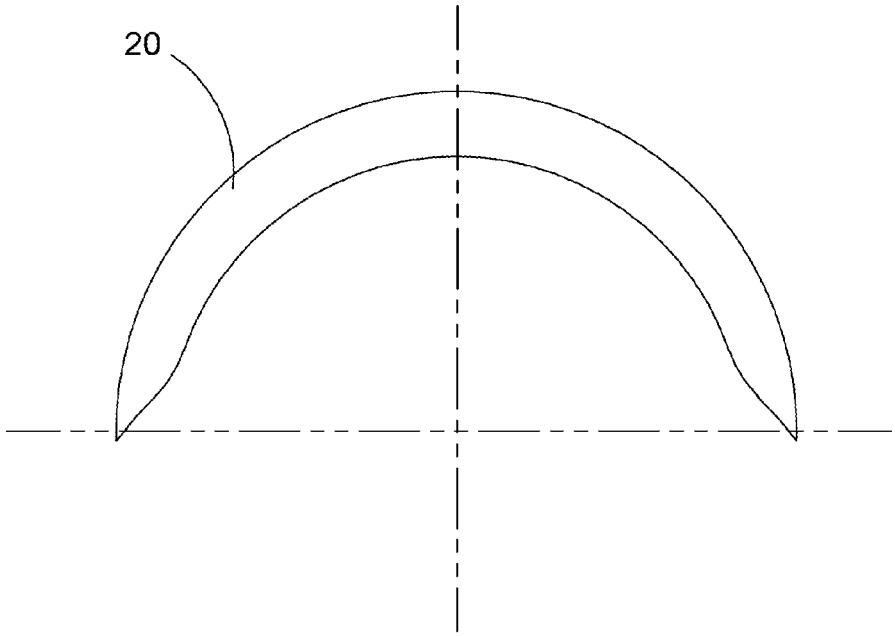

Louver assembly 22 is mounted inside visor frame 40. FIGS. 5A-E show base visor 18, visor frame 40 and reflective strips 252, and louver assembly 22 assembled onto lens rim 17. FIGS. 6A-C show louver assembly 22 in isolation and FIGS. 6D-E installed into visor 70C. FIGS. 7A-C show distal visor shell 20 in isolation. FIGS. 8A-E show the complete assembly of visor 70C.

As can be seen, the primary differences between visor 70C of the exemplary embodiment of the present invention and visors 70A and B of US publication Nos. 2006/0176695 and 2006/0181882 are as follows.

First, the front distal extension section or distal visor shell 20 of visor 70C is shorter than in extension 250 of visor 70A of US publication No. 2006/0176695. The length of the extension 20 for 70C is determined by balancing spill and glare with up-light. FIG. 6D shows the extension length presently found to be preferable for use with fixture 10 of exemplary embodiment 1. This shortened length is necessary to prevent cutoff of up-light that would occur with longer extension lengths, such as those used in 70A and 70B, US publication Nos. 2006/0176695 and 2006/0181882. The shortened visor extension 20 of visor 70C is attached to the base visor 18 similar to the method described for visor 70A of US publication No. 2006/0176695. FIG. 7A of the present application illustrates the visor extension 20 in a flat sheet metal pattern. FIG. 7B shows a side view of visor 70C when formed for fixture 10. FIG. 7C shows a front view of FIG. 7B. As can be appreciated, this distal end of visor 70C is described as shorter than conventional visors in comparison to the visors of US publication Nos. 2006/0176695 and 2006/0181882. The general concept is that visor 70C is intentionally shortened from conventional glare and spill visors to intentionally allow some up-light, which is antagonistic to the goal of limiting light from traveling outside the target area. Specifically the main difference is that distal visor piece 20 for visor 70C, although similar in general shape to visor 70A of US publication Nos. 2006/0176695 and 2006/0181882, is shorter (five inches) from front to back (a five inch version) than visors 70A and B. As mentioned, the similar piece for visors 70A and B is seven and fourteen inches respectively. Therefore, visor 70C can be constructed in the same manner, including highly reflective strips 252, as visors 70A and B of the above-identified incorporated by reference applications. All that differs is that the single piece distal portion 20 is shortened to the five inch version, instead of the seven or fourteen inch version. This makes manufacturing and assembly of any of the versions efficient and easy.

Second, visor 70C includes highly reflective louver plate 50 to direct and control up-light with minimum light lost to the target. The size (width and length) of louver plate 50, as well as its position and angle, can be varied to change the direction and intensity of the up-light. Testing has found the size, position and pitch of louver plate 50 shown in FIGS. 6A-E to provide optimal up-light for aerial illumination with fixture 10 of this exemplary embodiment 1. Note in FIGS. 8A-E how plate 50 only occupies a relatively small part of the total space inside visor. Plate 50 is relatively small in area, is thin, and is angled slightly relative to much of the light energy or beam generated from the fixture. In the embodiment of those FIGS. 8A-E, it takes just a small amount of the light from the beam and redirects it upwardly at normal fixture aiming angles. The relatively short visor 70A allows an appreciable amount of this redirected light to pass upward for up-light for aerial viewing or lighting.

Figure 11:
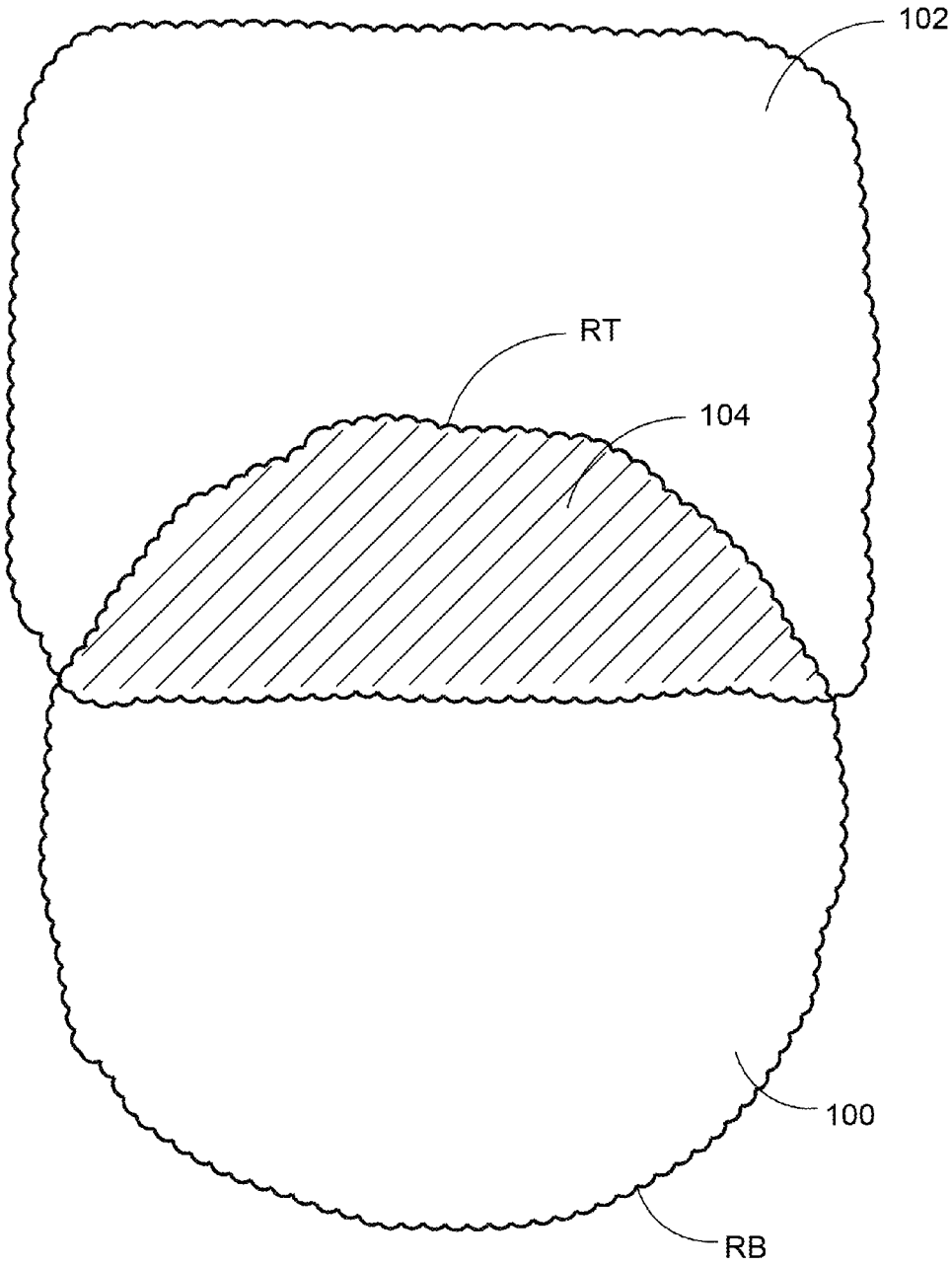
FIG. 11 is a diagrammatic illustration of a beam pattern according to Example 1 projected onto a planar surface, showing the transition between main beam portion and the up-lighting portion from the louver of Example 1.

However, other variations in size and methods of field adjustments are considered to be included in this invention. The position, pitch and size of the plate all work conjointly to marry the light beam produced by the up-light louver with the target beam to provide smooth transition between the cutoff from the visor and the up-light. FIG. 11 diagrammatically illustrates this point. Main beam 100 of fixture 10 would have somewhat of a circular shape if projected on a wall, but with glare and spill control would have a flattened top. Louver plate 50 would project a somewhat rectangular beam pattern 102. The position of plate 50, its angle, and its shape would be designed to blend the lower part of 102 with the top of 100. There would be a slight overlap (area 104) for blending, but not too much because it is not usually desirable to build up a spot or portion with a lot more light. The goal would normally be for a substantially smooth transition between 100 and 102.

The louver assembly attachment 22 shown in the Figures is fixed, but could easily be mounted on a rod, or similar pivoting method, to allow for field adjustment of the pitch. In addition, the support gusset 56, FIGS. 6B-D, could be designed as a sliding plate to allow for different pitches. Methods for allowing such adjustment are common and within the skill of those skilled in the art, and are included as options for this embodiment.

Regarding adjustability, as can be appreciated by those skilled in the art, louver assembly 22 could be the same for all fixtures on which it is used. It could be fixed into position by screws, rivets, or other attachment methods. Because only a small fraction of light from fixture 10 is used for the up-lighting, a standard, fixed louver assembly 22, in many cases, likely could adequately accomplish this purpose. On the other hand, as is well known in the art, fixtures 10 are frequently installed at different aiming angles down from vertical. Therefore, a louver that is the same size, shape, pitch or angle, and position in every fixture 10 would, by the laws of physics, throw up-light up in the air at different angles. If the designer wanted approximately the same angle relative to horizontal (regardless of aiming angle of the fixture), louvers 22 could be installed individually in each fixture to the same angle relative to horizontal. Alternatively, as mentioned, louvers 22 could be installed on structure that would allow them to be adjusted or rotated and then fixed in position by the installer to vary the angle or pitch relative its reflector. For example, the installer could rotate each louver to the same pitch relative to horizontal even though many of the fixtures would have different aiming angles relative to horizontal.

Still further, louvers could be customized for different fixtures, if desired or needed. By reference to the beam pattern of FIG. 11, the pitch, size, and location of louver plate or surface 50 of louver assembly 22 usually would be selected to take a fraction of light from the light beam of fixture 10 and start at the top of the beam 100 produced by fixture 10 and extend upward. In exemplary embodiment 1, with visor 70C and louver plate 50, fixture 10 would approximately produce the beam 100 of FIG. 11. It would have a relatively sharp top cut-off because of visor 70C, which is beneficial for glare and spill control. Louver plate 50 would produce the rectangular type shape 102 that would basically have a lower edge at or near the top edge of beam 100 and extend up. One of skill in the art could alter the configuration of louver plate 50 to achieve different shapes, if needed or desired.

Further note that the up-lighting techniques of the exemplary embodiments could be placed on all fixtures 10 for a field. Alternatively, they could be put in only selected fixtures. For example, they could be used for all or most fixtures for a full baseball field lighting system like that of FIG. 2A. By living with, for example, about a 5% reduction of light to field 2 to create the up-light at levels indicated with the exemplary embodiments, the loss of light to the field can many times be acceptable. The benefit of the up-lighting is accomplished, and glare and spill control is not usually unacceptably affected. However, up-lighting from exemplary embodiments described herein could be placed on less than all fixtures 10. For example, it may be that sufficient up-light can be achieved without all fixtures 10 having the modification. This would achieve some up-lighting but with less loss of light to the target. Also, there are cases where specific fixtures 10 must have enhanced glare and spill control (e.g. need a longer visor and/or cannot throw light upward). These variations can also be utilized in a system of a plurality of light fixtures while maintaining sufficient up-light.

Figure 5E:
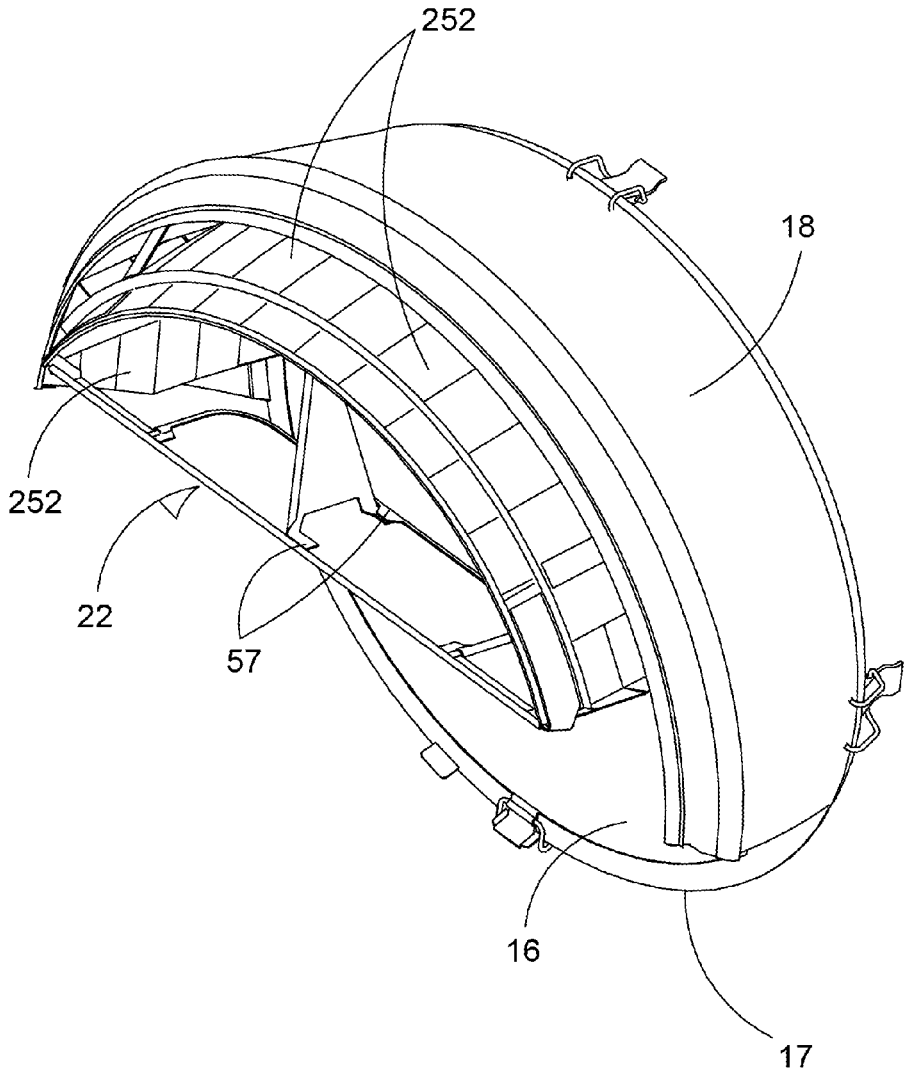

The construction and attachment of the visor louver assembly 22 will now be described in greater detail. As discussed above, base visor 18 and its attachment to the fixture 10 is similar in construction to the base visor described in US publication No. 2006/0176695, and also US publication Nos. 2006/0181882 and 2006/0101875, now U.S. Pat. No. 7,789, 540. In one embodiment the highly reflective (in this example, pebbled) aluminum plate 50 is constructed with a rigid backing plate 51 of the same size, sandwiched together by an extruded rail 53 formed around the perimeter of the plates 50, 51 to provide rigidity. These louver plates, with rail, are fastened to a support bar 52 that extends horizontally across the visor. The support bar 52 is fastened to formed aluminum tabs 54L and R that are, in turn, fastened to the visor frame 40 as shown in FIGS. 5E and 6D. To further support the louver plates, a formed sheet metal gusset 56, is fastened to plate 50 at tabs 57 (FIG. 5E) and to visor frame 40 at tab 58 (FIG. 6B). Note that gusset 56 is essentially in a plane that would be parallel with the optical axis of reflector 15 to minimize blockage of light from fixture 10 or redirection of light to undesired directions. The size of the other supporting structure for reflective louver plate 50 is likewise so designed. Testing has found the pebbled (i.e. peened or hammered) material to provide a nice beam spread. Such peening or hammering is well known in the art.

Alternate materials and configurations for the reflective plate 50 could be used to change the beam shape. A specular material could be used to provide a narrow and focused beam. A curved reflective plate 50 could also be used to control the beam spread. These non-limiting optional materials and configurations should be considered as part of this invention, as are other configurations and variations such as would be obvious to one skilled in the art.

Note that highly reflective strips 252 are placed on visor frame 40 to reflect light instead of just block or absorb light. As indicated in FIGS. 1A-C, some of that light will be redirected by plate 50 for up-light, but most will be directed to field 2. The highly reflective surface of plate 50 can be of the same or similar material to that disclosed in U.S. Pat. No. 6,203,176 and US publication No. 2006/0181882.

FIG. 6D gives additional details regarding size, angle, and position of louver plate 50. These dimensions can vary according to need. In this embodiment, plate 50 is tipped slightly downward relative to the plane of lens frame 17, and thus plate 50 would be tipped slightly downward relative to the central beam axis that would emanate from fixture 10 (which normally would be along the optical axis indicated in FIG. 6D). Note also the relationship of plate 50 to the distal visor shell 20. Not all light reflecting off of plate 50 would be allowed to pass directly out of visor 70C. Shell 20 would cut off some. Note further that plate 50 extends only partially across visor 70C and has a somewhat narrow front to back dimension (e.g. four inches). It also is positioned near the very front of visor 70C. Therefore, plate 50 is redirecting only a relatively small fraction of total light out of fixture 10.

FIGS. 8A-E show visor 70C assembled. FIGS. 4D and E show visor 70C ready for latching to fixture 10, and then latched in place, respectively.

D. Specific Example Apparatus 2

FIGS. 9A-E show an alternate exemplary embodiment of the present invention. This example embodiment 2 is similar to the above exemplary embodiment 1. The primary difference is that, in lieu of the adjustable louver assembly 22 to direct light upward, a set of stepped reflective strips 120 of highly reflective material would be placed in the lower hemisphere of the bowl-shaped reflector 15 to do so.

U.S. Pat. No. 6,203,176 describes a variety of inserts, as does US publication No. 2006/0176695. One embodiment is a stepped insert 120, shown in side cross section in FIG. 9D of the present application. It would function like the side-shifting inserts 120 of US publication No. 2006/0176695 to shift a portion of the beam from fixture 10 upward. It would essentially create a beam shape not unlike the combination of 100 and 102 in FIG. 11, with a primary beam 100 and a fraction of light energy in portion 102, some of which would be allowed to pass visor 70C for up-lighting.

Figure 3A:
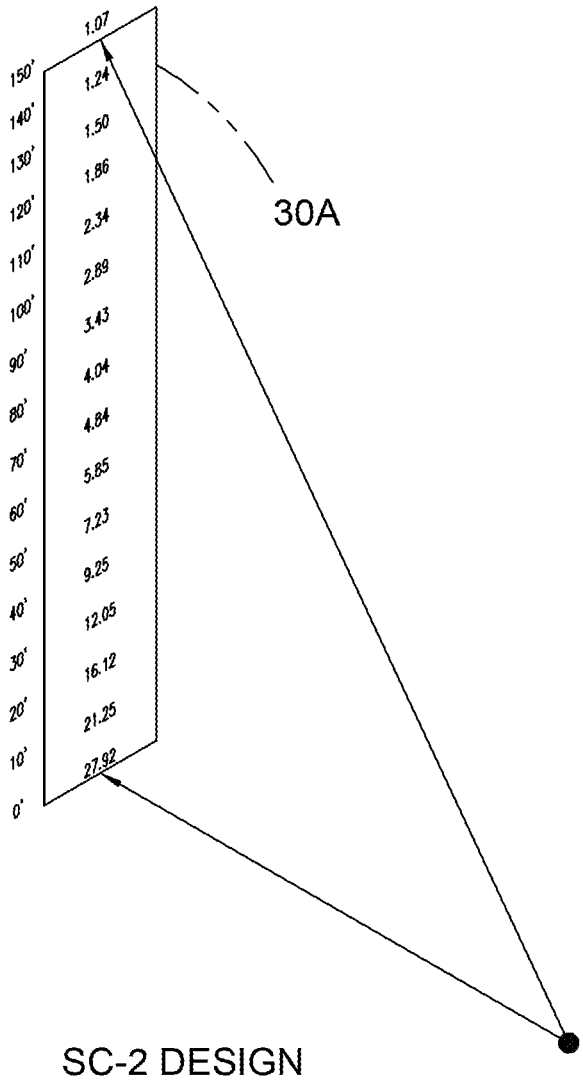
FIG. 3A is an illustration of light level measurements made using the methodology of FIGS. 2C-E relative to a commercially available SportsCluster-2®™ lighting fixture that does not use a visor or louvers.
Figure 3B:
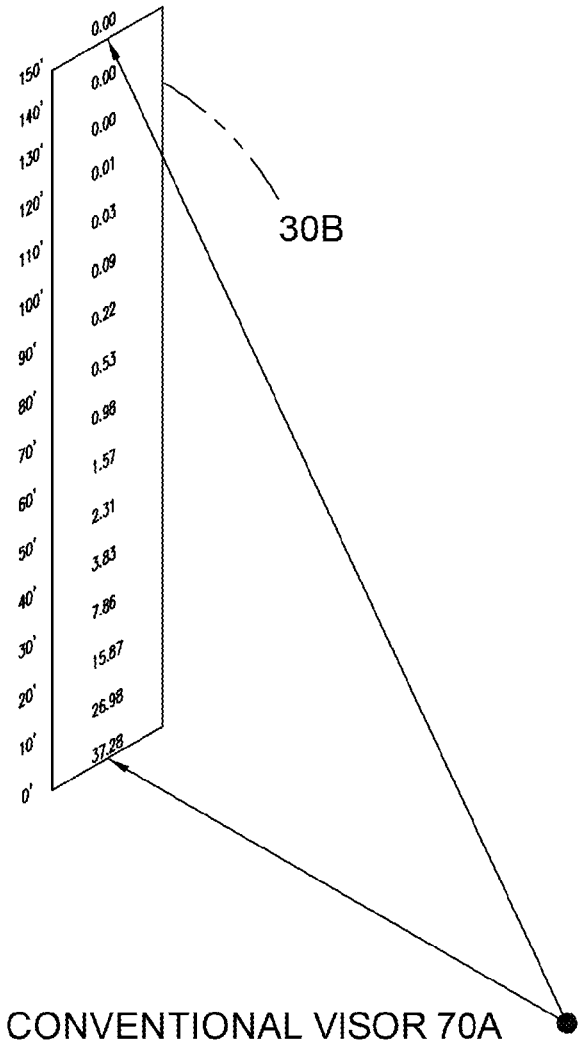
FIG. 3B is similar to FIG. 3A except showing light level measurements relative to a longer visor fixture 70A of FIGS. 47A and B of US publication No. 2006/0176695.
Figure 3C:
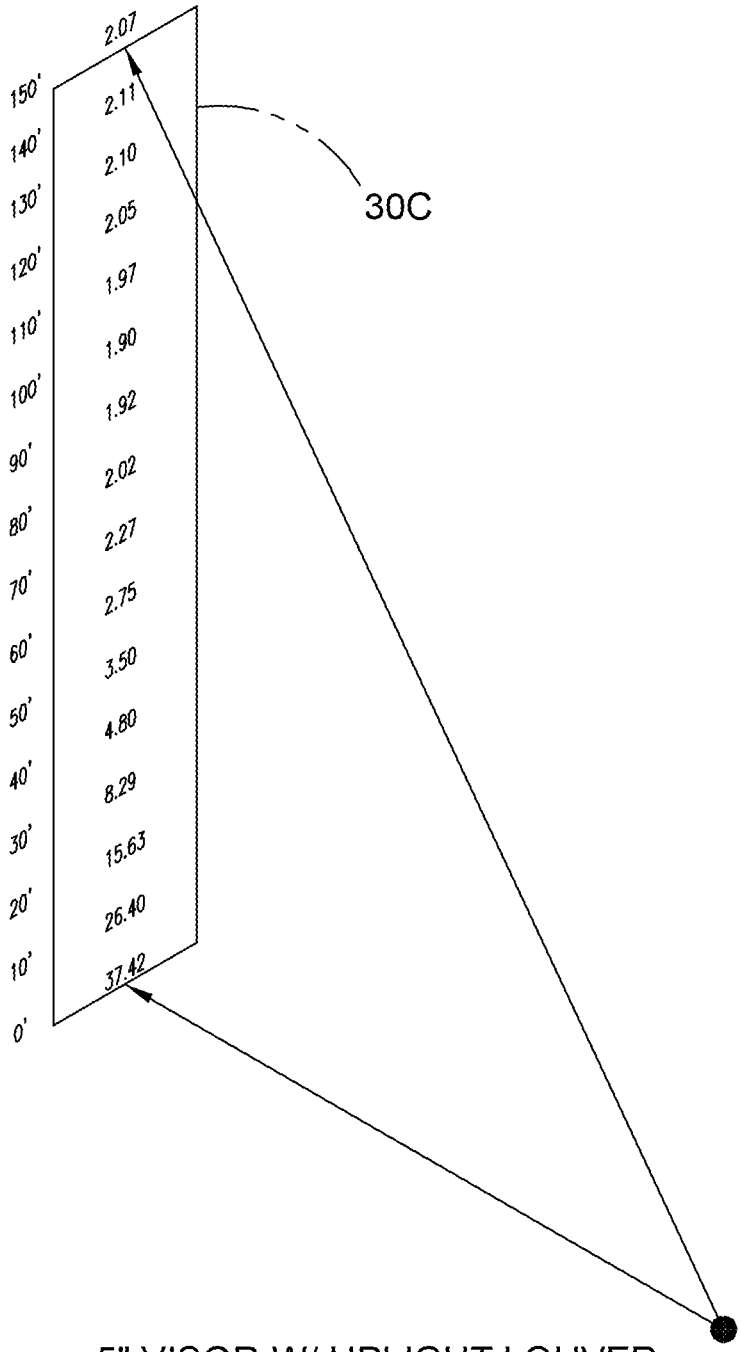
FIG. 3C is similar to FIG. 3A except showing light level measurements relative to a first exemplary embodiment according to the present invention shown in FIGS. 1B, 1C, 4A-E, 5A-E, 6A-E, 7A-C, and 8A-E; the short visor and internal louver of Example 1 of the Detailed Description of Exemplary Embodiments.
Figure 3D:
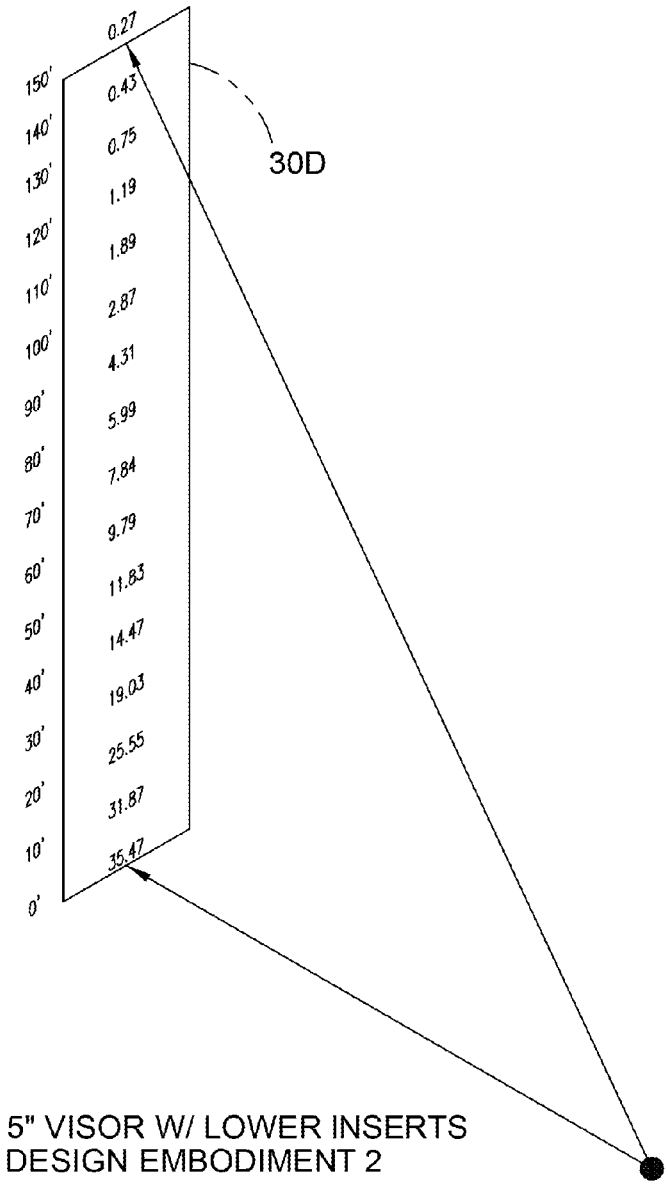
FIG. 3D is similar to FIG. 3A except showing light level measurements relative to a second first exemplary embodiment according to the present invention shown in FIGS. 9A-E; the short visor and stepped highly reflective insert of Example 2 of the Detailed Description of Exemplary Embodiments.

FIG. 3D shows the amount of up-lighting that is believed possible with embodiment 2. In this embodiment, 5 or 6 out of the 25 to 30 inserts 120 in the very bottom of reflector 15 would be replaced by the special stepped inserts 120. Therefore, about 20% to 25% of inserts 120 would shift some light up in the beam for up-light. Like embodiment 1, this might take some light away from the target (field 2), but normally it would be designed to take no more than a few percent (e.g. no more than about 5%).

The use of plural inserts 120 allows easy design and assembly of both the special stepped inserts for up-light, and other inserts for producing the main beam from fixture 10. As can be appreciated, the subset of special up-light inserts 120 would have a shape and reflecting characteristics that would throw more light upward in a controlled way to produce an up-light pattern, e.g., similar to that of reference numeral 102 of FIG. 11. However, different configuration of those inserts could produce a different composite pattern 102, if desired. Also, the number of up-light inserts could be altered for different amounts of up-light.

The attachment method for the stepped reflective strips 120 can be the same as described for strips 120 in fixture 10 of US publication No. 2006/0176695. Other attachment methods are, of course, possible.

FIGS. 9A-E, shows the embodiment in exploded and then fully assembled forms.

Figure 9D:
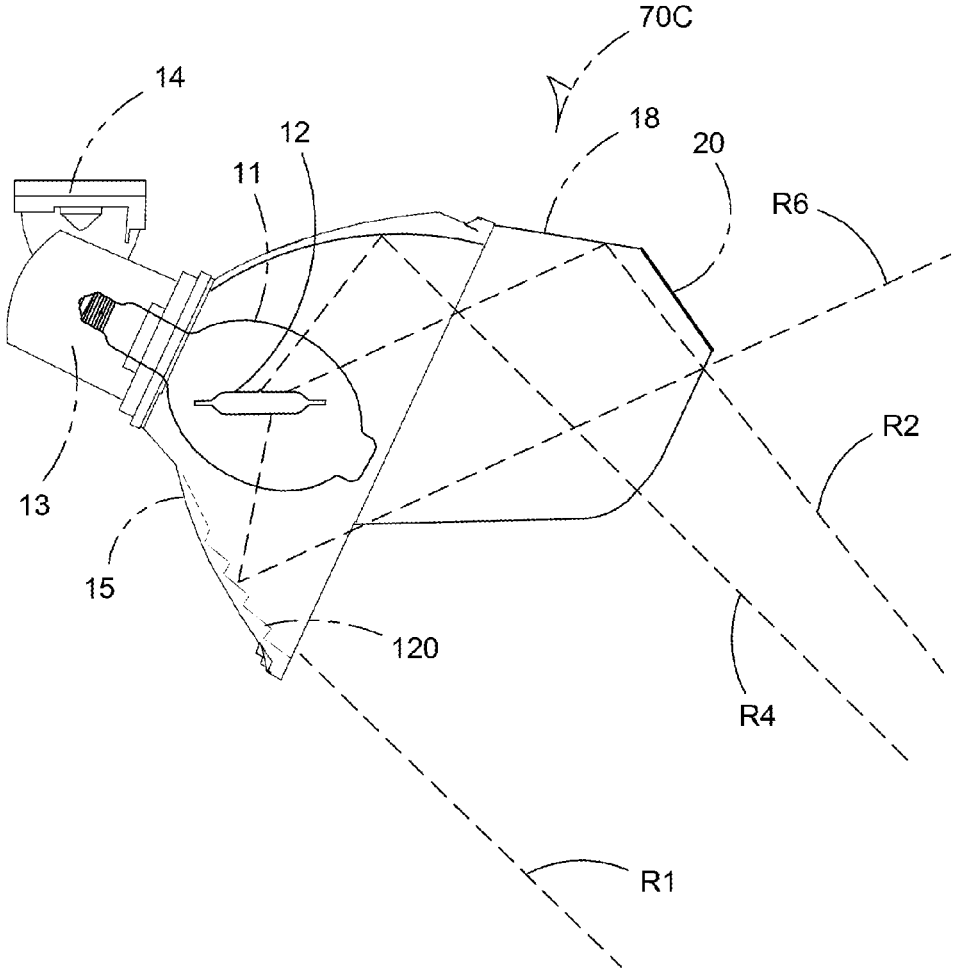
Figure 9E:
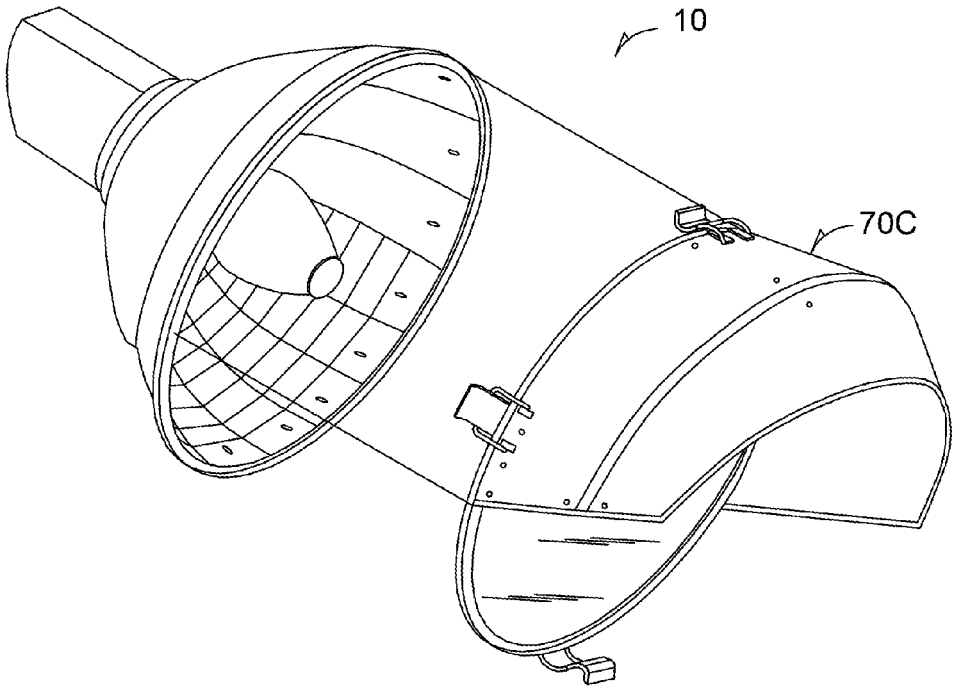
Figure 9E:
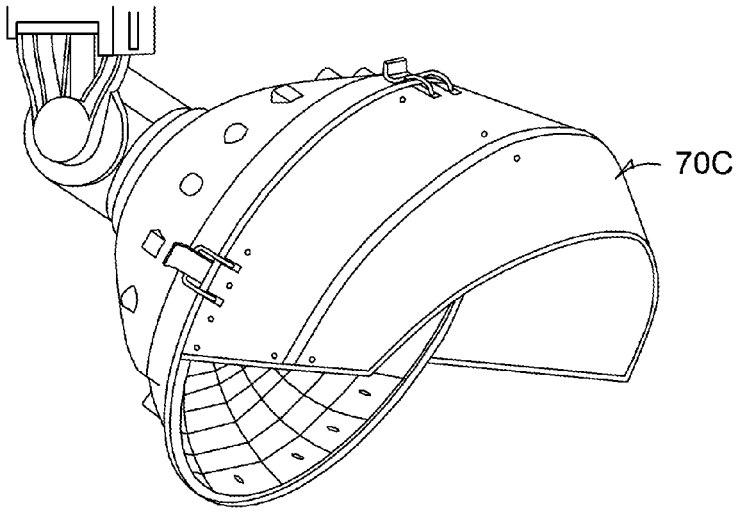
Figure 10A:
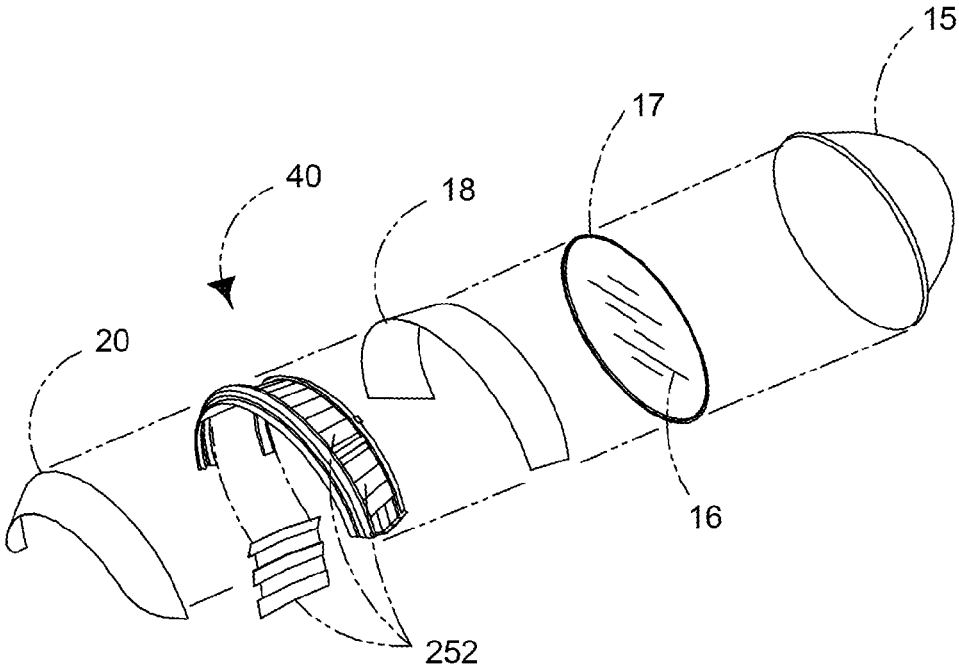
FIGS. 10A-E are perspective fully exploded, perspective partially exploded, perspective assembled, side elevation, and perspective comparison views, respectively, of a Third Example according to a still further alternative exemplary embodiment of the present invention.
Figure 10B:
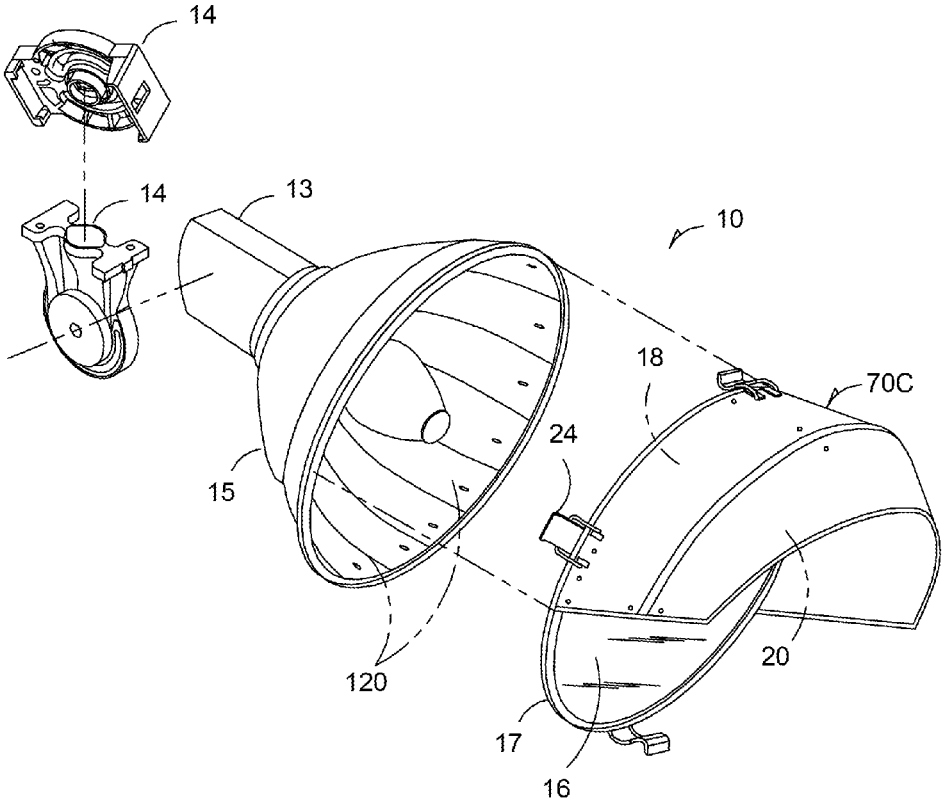
Figure 10C:
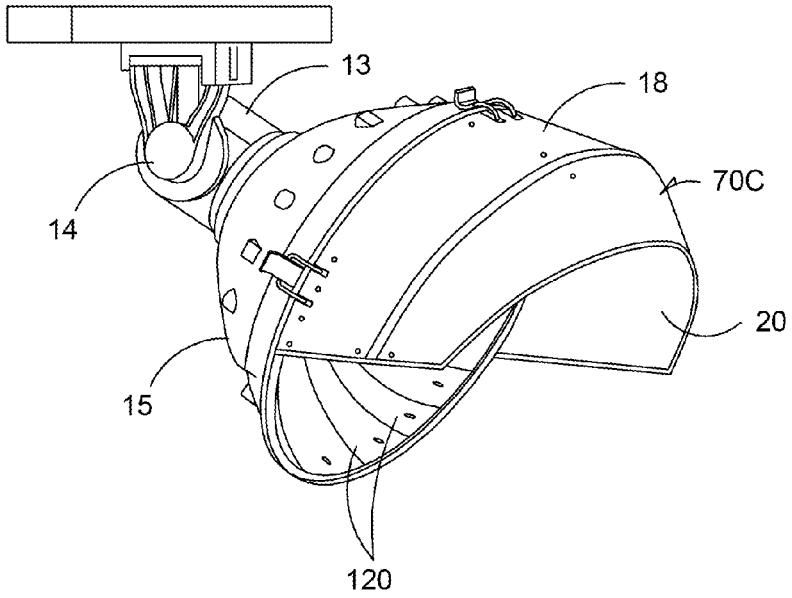
Figure 10D:
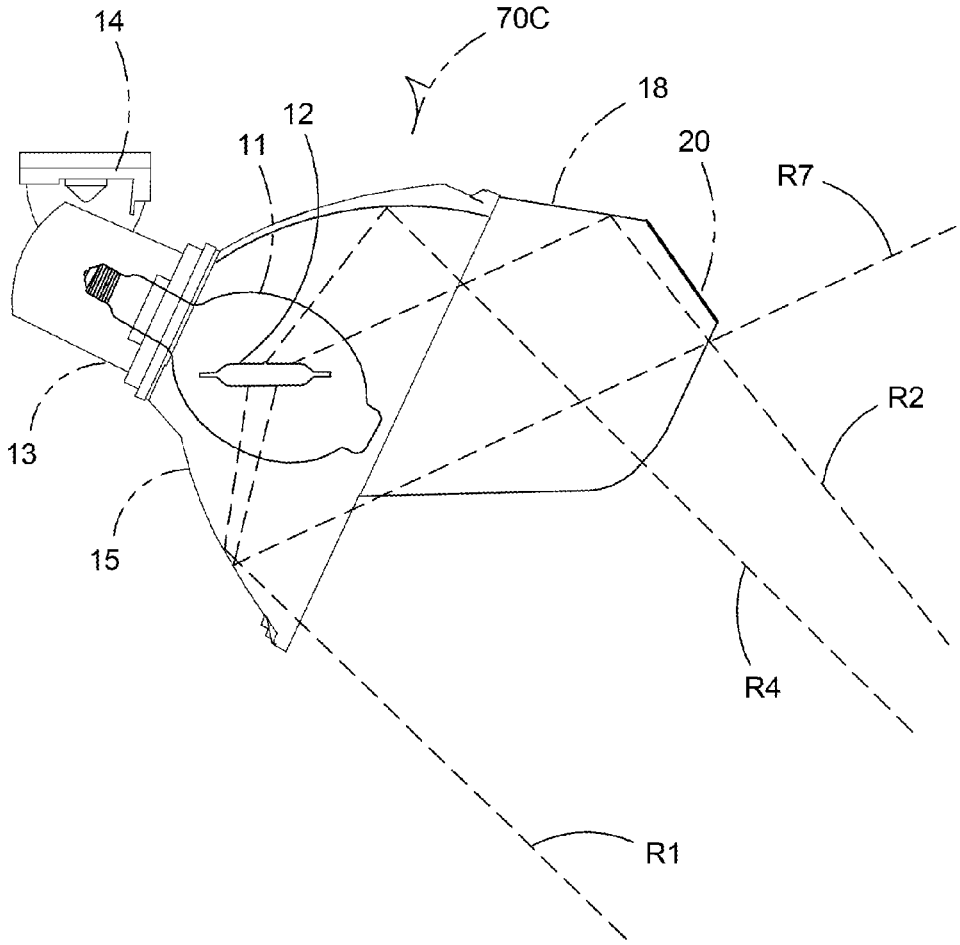
Figure 10E:
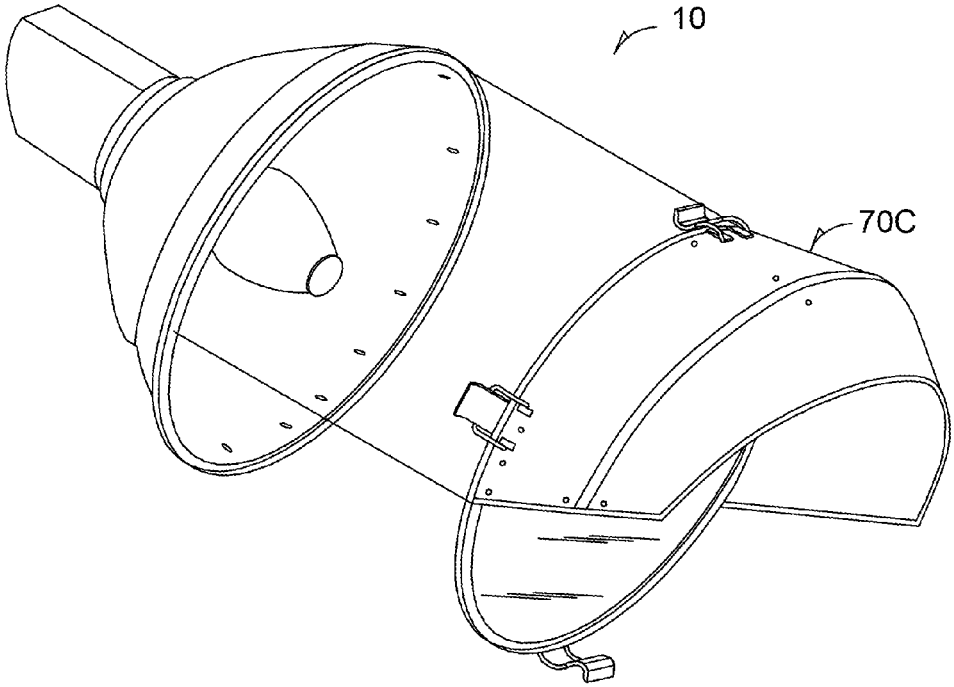
Figure 10E:
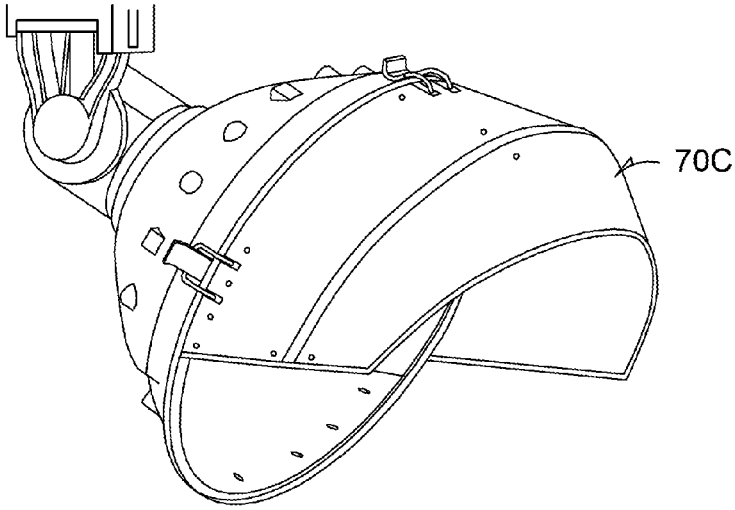

FIG. 9D is a rough diagram illustrating how (a) strips 120 redirect some light up for up-lighting (see, e.g., one illustrative light ray R6), (b) shortened visor 70C lets this up-light by, but (c) visor 70C and the remainder of fixture 10 still provide efficient delivery of light to field 2 with reasonable spill and glare control (see rays R1, R2 and R4).

The method of this second embodiment, used with a shortened visor 70C (or even no visor), can provide sufficient light upward for aerial viewing. However, this embodiment is secondary to the exemplary embodiment 1 as it disperses light vertically, similar to some related art.

If stepped inserts 120 are used with no visor, less glare and spill control would likely be achieved. However, the designer can choose what balance of glare and spill control versus up-lighting and efficiency if desired. Also, the designer can configure different fixtures 10 with different combinations of inserts 120 and/or visor (or no visor) combinations to cumulatively achieve a desired result.

E. Specific Example Apparatus 3

FIGS. 10A-E, show another alternate exemplary embodiment of the present invention. This embodiment 3 is similar to exemplary embodiment 2. A louver assembly is not used.

This embodiment still utilizes the shortened visor extension 20 on fixture 10 such as shown and described in US publication No. 2006/0176695, FIG. 4, and such as used with embodiments 1 and 2. However, the special up-light stepped inserts 120 of embodiment are not used. Instead, inserts 120 for reflector frame 15 are simply selected to produce the desired overall beam type for illumination of the target. They are not selected to or specially configured to intentionally divert light from the target for up-light. The use of the shortened visor 70C allows passage of an additional relatively small percentage of light (mainly from the bottom of the reflector) upward which thus provides some up-light for aerial viewing (see, e.g., illustrative light rate R7).

This embodiment could be used for applications that require slight increases in up-light (e.g. more so than provided by conventional visors), but less up-light than exemplary embodiments 1 or 2 provide. The advantage of this embodiment is target illumination levels are even less impacted, but a slight increase in up-light is achieved while maintaining some glare and spill control (see, e.g., illustrative rays R1, R2, R4).

Again, many of the plural fixtures could be configured according to this third embodiment, if the design indicates. Or, only some fixtures could be configured with this third embodiment. Or, still further, some fixtures could be configured with this third embodiment, and others could be configured with the first and/or second embodiment.

F. Simulations of Up-Light or Aerial Illumination Levels

To illustrate the control of up-light, and at consistent levels, computer models were created based on a typical eight pole baseball lighting design (e.g. FIG. 2A) using four different fixture options. To provide equal comparison, all four simulations used the same target light levels, uniformities and mounting heights (see FIG. 2B), but had different visors and optics. The aiming method is shown in FIG. 2A. The same quantity of fixtures was used for each design. However, to achieve the same light level in the outfield, a multiplier was applied to the fixture's lumen output in some designs to account for differences in efficiency.

Figure 2D:
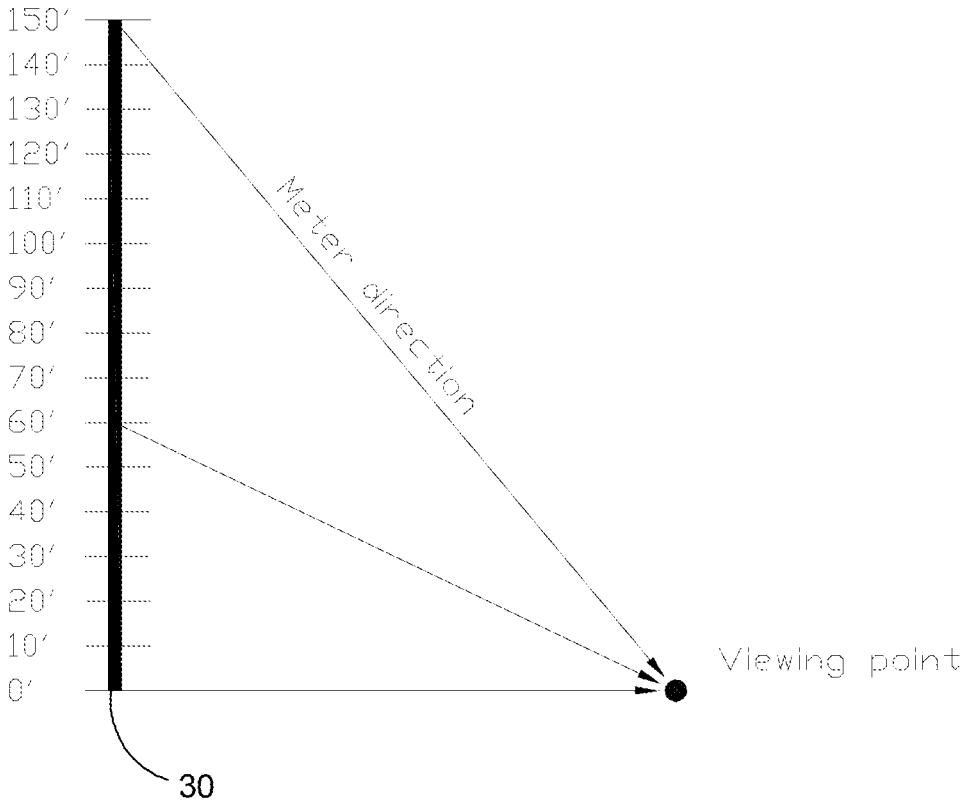
Figure 2E:
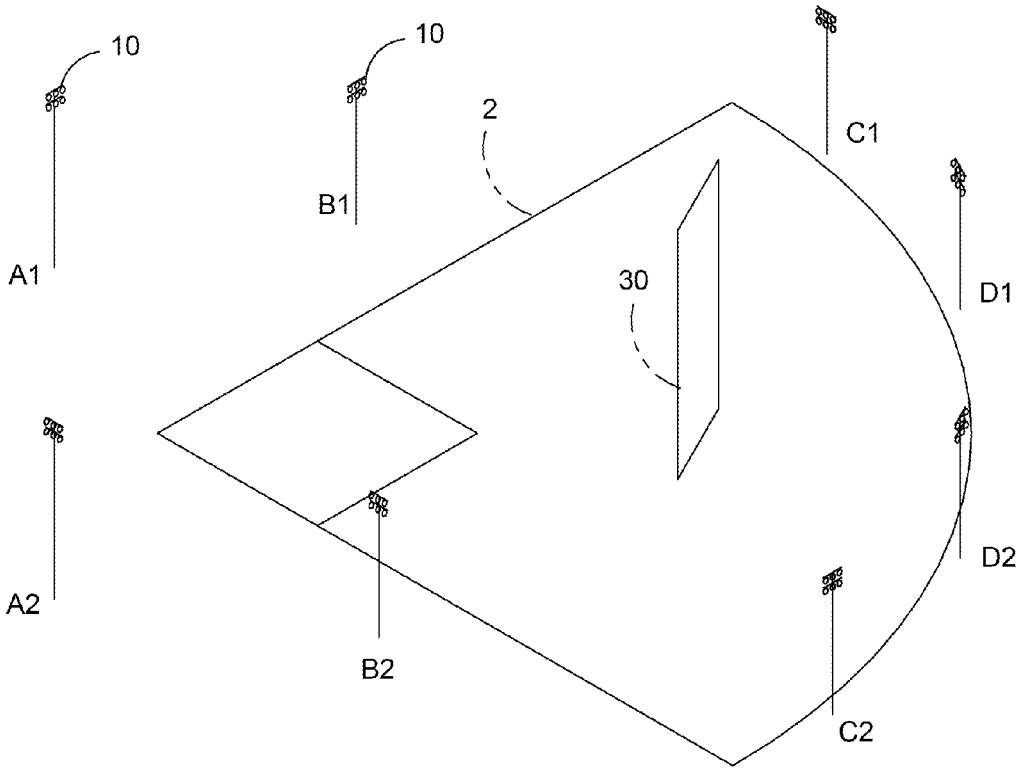

To represent aerial illumination (i.e. light on the ball), vertical foot-candles metric ($fc_{vertical\ metric}$) to a common point was used (see FIG. 2D). This represents the amount of illumination in a plane perpendicular to the vantage point, or in the case of aerial sports, the amount of light on the ball at a given elevation. To simulate such, a vertical wall (reference no. 30) about 30 feet wide and 150 feet in elevation was created in the computer model with vertical foot-candles calculated at 10 feet increments. FIG. 2E is a rough diagrammatical depiction of this hypothetical vertical wall.

FIG. 3A simulates a conventional fixture (MUSCO® brand SportsCluster-2®) without any spill and glare control in the sense of visors or louvers. As shown by the vertical foot-candles levels 30A on the vertical wall, the light is high at lower levels and rapidly diminishes with elevation. This may provide sufficient aerial illumination for some playability, however improvements could be made to improve playability and provide more consistent light through different vertical elevations. Note the 7.23 fc reading at 50' and the 1.07 reading at 150'.

FIG. 3B simulates a fixture with a glare and spill control visor (visor 70A from US publication No. 2006/0176695). As can be seen, light levels drop to zero $fc_{vertical}$ before 150 feet in elevation. They are quite low at 70 feet, and even 40 feet.

FIG. 3C simulates exemplary embodiment 1 with the shortened visor 70C and internal up-light louver 50 to direct light upward. As shown by the vertical foot-candle levels 30C on the vertical wall, light at lower elevations is similar to other fixtures with spill and glare control, but the light level at upper elevations is held at a quite consistent level (see, e.g., foot-candle levels for 60 to 150 feet are all around 2 foot-candles).

FIG. 3D simulates exemplary embodiment 2 with the shortened visor, no louver to direct light upward, but instead stepped inserts 120 placed in the lower hemisphere of the reflector 15. As shown by the vertical foot-candle levels 30D on the vertical wall, light diminishes rapidly with elevation. While sufficient illumination for most aerial applications likely exists, similar consistency concerns as with the Sports-Cluster-2® fixture of FIG. 3A exist. However, spill and glare is substantially controlled. Note how illumination levels are not as consistent as embodiment 1 (see chart of FIG. 3C), but that more up-light is present than a more conventional spill and glare fixture (see chart of FIG. 3B).

Figure 3E:
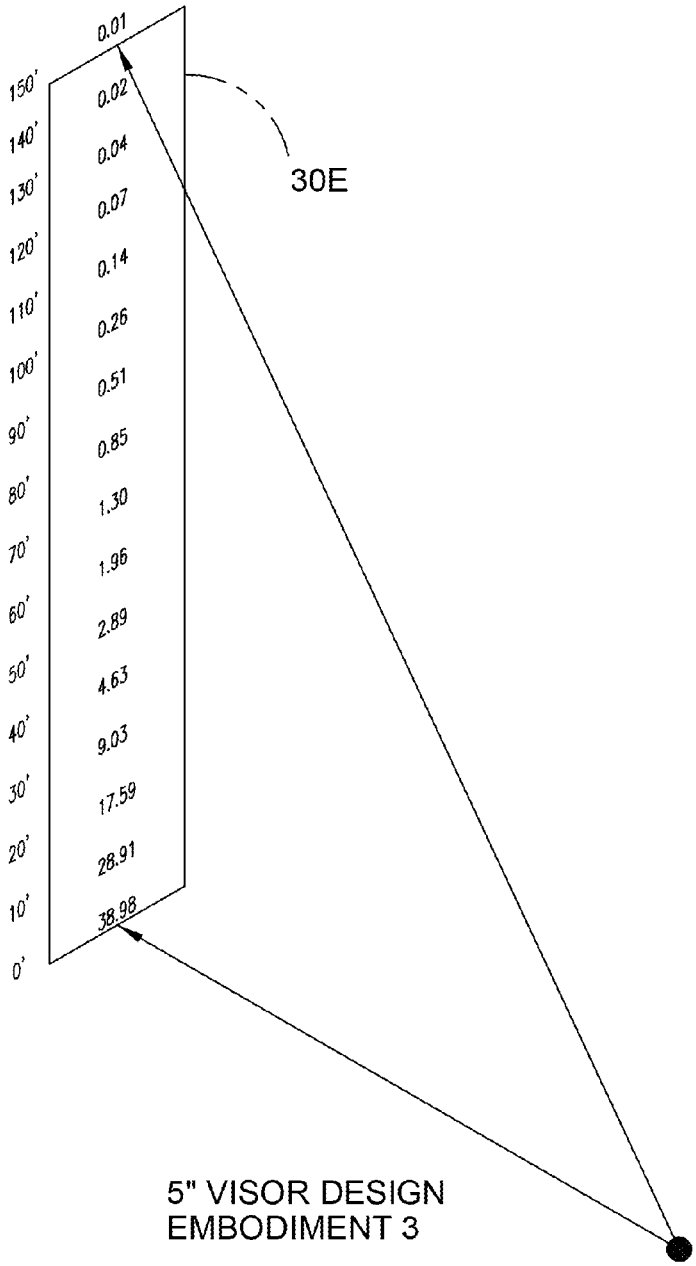
FIG. 3E is similar to FIG. 3A except showing light level measurements relative to a third exemplary embodiment according to the present invention shown in FIGS. 10A-E; the short visor and highly reflective insert of Example 3 of the Detailed Description of Exemplary Embodiments.

FIG. 3E simulates exemplary embodiment 3 with shortened visor 70C but without the louver assembly 22 of embodiment 1 or the special up-light stepped inserts of embodiment 2. As shown by the vertical foot-candle levels 30E on the vertical wall, light also diminishes rapidly with elevation. In some cases, this field would not provide sufficient aerial illumination for playability. FIG. 3E shows that embodiment 3 may provide less up-light than embodiment 2 (FIG. 3D), but more than the more conventional spill and glare fixture of FIG. 3B.

G. Uses and Methods for Exemplary Embodiments a) Uses

A primary use for the invention is for aerial illumination of wide area lighting that requires viewing of objects high above the ground or other surface. The exemplary embodiments have been discussed in the context of sports lighting, but they are not limited to that type of wide area lighting. The embodiments can be considered for a number of lighting applications.

With respect to sports lighting, one application is to baseball and softball fields with higher levels of play (i.e. players with greater abilities, such as high school, college, and professionals) that require viewing of the ball at elevations generally greater than 40 feet above the target. Sometimes the size of the field can indicate if up-light may be needed as larger fields are generally used for higher levels of play. For example, a 200 foot radius baseball field may not be a concern, but a greater than 250 feet radius field may. Another sports-related application would be golf courses and driving ranges due to the need to track the ball at higher elevations.

In comparison, for lower elevations, some light is reflected off the target surface and some light is available from the fixtures if below the visor cutoff. This amount of light is generally sufficient for viewing objects if less than 40 feet. Example of applications that generally fall in the less than 40 feet are soccer, tennis, lower levels of play for baseball and softball (such as Little League, Tee Ball).

Therefore, the designer would consider the need for up-light for different applications. If needed, the designer would have available different ways to achieve different quantities and characteristics of up-light with the three embodiments.

Analogous considerations would be taken into account for non-sports lighting applications that would need or desire up-light. For example, there could be non-sports-related entertainment venues with the need of up-light for aerial viewing. There could be commercial or security lighting with such needs. These are only a few non-limiting examples.

b) Typical Methods of Use with Sports Lighting

For typical uses with aerial sports, the invention would be used on all or most of the fixtures in the lighting design, perhaps with the exception of fixtures aimed downward at steep angles. This will generally be the best solution as almost no noticeable difference in glare will be experienced by a player or offsite, with somewhat minimum difference in spill light. This approach generally covers all viewing directions, which is important in the sense that it is unknown who may need to view the ball. For example, not only do outfielders need to track a ball coming over the center of the field, the baseball or softball catcher may need to catch a pop up. Also, the umpire needs to track both fair and foul balls. Additionally, it is usually desirable that spectators likewise be able to track fly balls. Conventional aiming practices for sports lighting fixtures and designs would normally still be applied even when this invention is used.

If desired to further improve playability for the players, the methods described in US publication No. 2006/0198145, now U.S. Pat. No. 7,458,700, can optionally be used. That method identifies key fixtures for application of long visors (e.g. visor 70B of US publication No. 2006/0176695). Other fixtures can use one of the exemplary embodiments 1, 2, or 3 described above. The long visors would reduce glare from just certain fixtures that could interfere with a player's ability to track a fly ball. Use of fixtures 10 according to one of the embodiments described herein could then also help supply additional up-light for playability.

c) Customized Uses for Site Consideration

In some cases, it may be desirable to customize the lighting system to meet the needs of the project. This could be for reasons of meeting special offsite spill and glare needs, higher intensity levels for aerial illumination, or even higher elevations of illumination.

Using the example of exemplary embodiment 1, for some situations, simply adjusting the pitch on louver plate 50 on one or more of the fixtures 10 may address the need. For others, changes to the size of plate 50 may be required. However, it is important to note that changes to the louver plate will likely decrease the light to the target. To describe how adjustments can be made, and the results that would likely occur, the following examples may best define the principles.

To reduce offsite spill at a key point, one or more fixtures 10 that are aimed in the direction of the area of concern can be adjusted. For example, the pitch of louver 50 can be increased to raise the beam over a house to try to alleviate a glare or spill light issue for a single off-field location. Based on the science of reflection (i.e. angle of reflection is equal to the angle of incidence), for every degree of change of louver plate 50, the beam location will change by 2 degrees. However, raising the beam to clear a house may decrease the overall effectiveness of the up-light if, in turn, the upper part of the beam is cutoff by the leading edge of the visor. As can be appreciated by referring to FIGS. 1B and C, for example, if louver 50 is angled too steeply upward, it would throw much of its reflected light energy up into visor 70C instead of past it. This would essentially attenuate the up-light advantage from it.

To change the intensity and the size of the beam, the width of plate 50 in the direction of the reflector 15 can be adjusted. If the plate width is increased, the intensity of up-light will increase, as well as the beam will become larger in vertical size. If plate width is decreased, then intensity will decrease and the beam will be an overall smaller vertical beam. However, as the beam size increases vertically, blockage from the leading edge of the visor occurs.

Horizontal adjustments to louver plate 50 can also be made to vary the beam size and intensity. If the length of plate 50 is increased, then the horizontal beam spread will also increase until the point at which light is cutoff by the visor. If the length is decreased, then the horizontal beam size also decreases. Along with beam size, intensity is impacted in the same manner.

As will be appreciated, the designer can take these types of things into consideration when designing a fixture 10 with louver 50. It will be appreciated that this allows the designer substantial flexibility.

Furthermore, analogous modifications can be considered with respect to at least some configurations of embodiments 2 and 3. With regard to embodiment 2, the size, shape, and reflecting characteristics of special up-light inserts 120 can be varied to achieve different outcomes. However, similar limitations also exist (e.g. directing light too steeply up may throw it into the bottom of the visor and thus diminish up-light). With regard to embodiment 3, less flexibility is available. However, some flexibility exists with the selection of the reflective inserts used on the reflector and on the specific length of visor 70C.

H. Options and Alternatives

The present invention can take many forms and embodiments. A few examples have been described in detail above. The examples and other disclosure are intended to give, however, an idea of some of the different variations that are possible. However, the invention is not limited to those examples. Variations obvious to those skilled in the art will be included within the scope of the invention, which is defined solely by the appended claims.

Figure 12A:
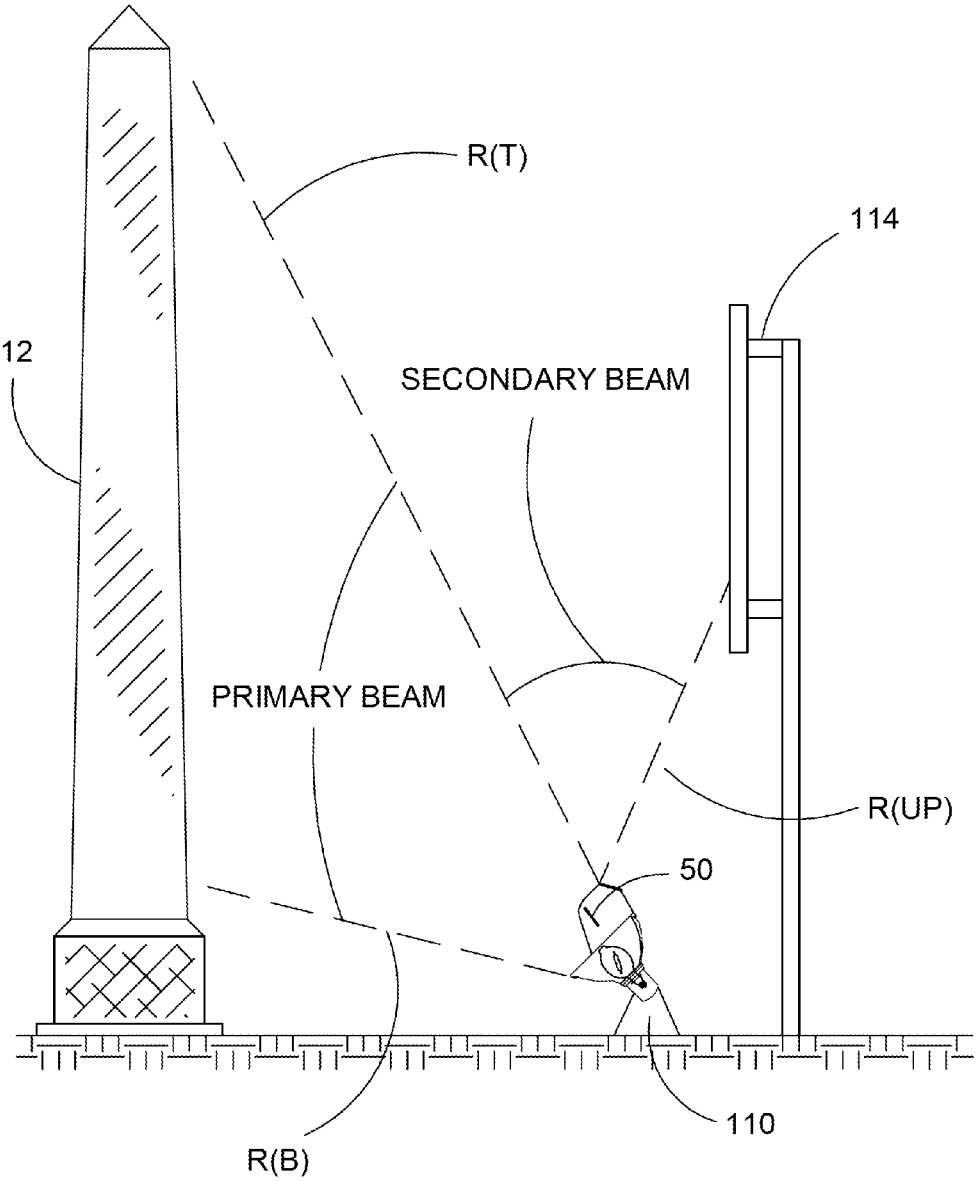
FIGS. 12A and B illustrate use of principles of the First Example for supplying primary and secondary light to different targets.
Figure 12B:
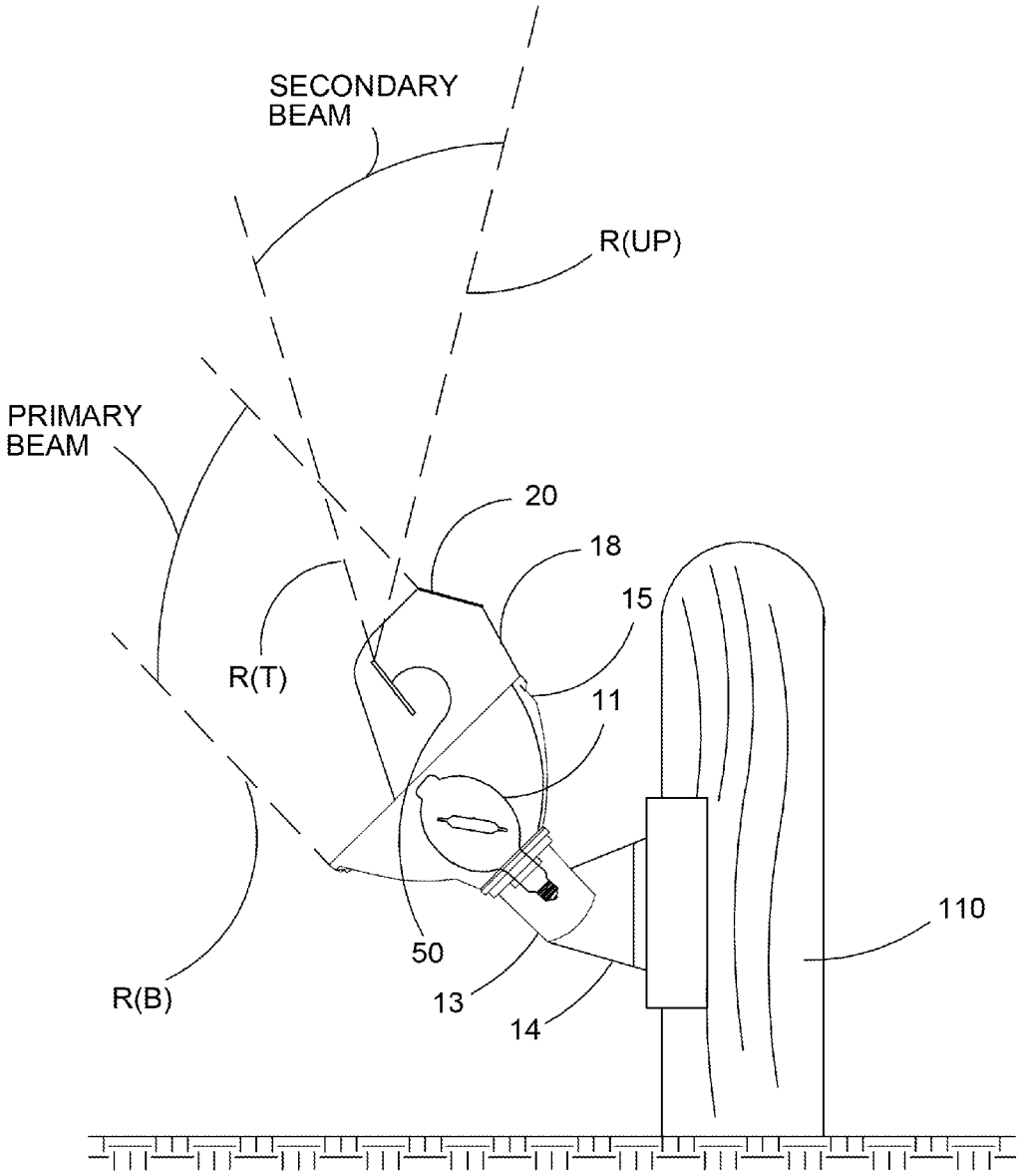

One example is illustrated in FIGS. 12A and B. Several principles of the invention can be applied to non-elevated lights. One example is the fixture in FIGS. 12A and B. It is placed near the ground on a support 110 (e.g. footing or very short stub pole). The fixture could include all the basic components of Example One, including a mounting elbow 14, bulb cone 13, reflector or reflector frame 15, a lamp 11 operatively mounted in bulb cone 13, and a shortened visor 70C with internal louver 50 (see FIG. 12B). As can be appreciated, what will be called the "primary" beam, the main controlled, concentrated beam from the fixture, could be configured to spread and illuminate at least a substantial portion of a first object (here relatively tall monument 112). By appropriate configuration of the fixture, the primary beam could have an upper margin R(T) that extends to at or near the top of monument 112, and the lower margin R(B) that extends to near the bottom of monument 112. According to the principles of the exemplary embodiments, placement of louver 50, in combination with shortened visor 70C, could allow a small percentage of light from the fixture to extend above, or more precisely, to the right of upper margin R(T) of the primary beam, and essentially produce some secondary light that could be directed to a second target such as sign or billboard 114 (FIG. 12A). In this example, monument 112 could be provided more light intensity. Billboard 114 would be provided a small percentage or fraction of available light energy from the fixture, but that fraction might be sufficient to provide illumination for sign or billboard 114.

Of course, the lighting could be reversed. The primary beam could be used to illuminate billboard 114 and the secondary light to softly illuminate monument 112.

FIGS. 12A and B further illustrate the flexibility of the invention. Not only could it be used to provide a primary beam to one side and secondary light to the other, if the fixture was rotated 90°, it could provide a primary beam for monument 112 but shift light to either out of the page or into the page to illuminate something to the lateral side of the fixture. There may even be circumstances where the fixture would be elevated but rotated 180° to provide a primary beam along the fixture's aiming axis and then shift or provide a small percentage of light down (the opposite of the up-light previously described).

Still further, the same concepts could be applied by using Examples Two or Three. Similar differences with Example One exist with respect to consistency of light outside the primary beam margin.

It must also be remembered that many applications of the invention will be used with at least a plurality of different light fixtures from a set of light fixtures designed to relatively uniformly illuminate a target area. As such, the designer, being armed with the ability to shift or redirect a percentage of light from any of the fixtures the designer chooses, can create different lighting results by the selection of which fixtures to add the principles according to this invention and which way the light is redirected, and how much of the light is redirected. In some cases, glare and spill control is not a primary concern or even a secondary concern. In those cases, side shift or down shift of a fraction of the light may achieve a desirable lighting effect.

As previously mentioned, in some applications, all fixtures will have components that follow the principles of the invention. Each of the fixtures will shift some fraction of its light outside the primary beam for a desirable designed purpose.

Furthermore, certain exemplary embodiments have been described in the context of sports lighting. Sports light typically uses high intensity discharge (HID) lamps surrounded by reflecting surfaces that can be from around one to several feet in diameter width. Principles of the present invention can be applied to a wide variety of light sources including but not limited to HID sources, and a wide variety of light fixtures. The principles can also be applied to lighting applications including but not limited to sports lighting and wide area lighting.

What is claimed is:

1. An apparatus for producing a generally controlled, concentrated beam from an elevated position towards a target area as well as glare and spill light control and uplighting comprising:

a. an elevated lighting fixture comprising:
   i. a light source with a multi-directional light output;
   ii. a primary reflector substantially surrounding the light source and comprising an upper portion and a lower portion,
      1. the primary reflector capturing and controlling a substantial amount of the light output from the light source into a controlled, concentrated substantially directional primary beam having:
         a. a central beam axis, and
         b. a beam spread generally distributed around the central beam axis;
   iii. an extension member at the upper portion of the primary reflector having an exterior and an interior and extending generally away from the primary reflector to a distal end in generally the same direction as the central beam axis but into the controlled, concentrated beam to block an upper margin of the controlled, concentrated beam and cut-off the beam spread at the upper margin for glare and spill light control; and
   iv. a reflective component having a reflective surface a fraction the size of the primary reflector and positioned in the interior of the extension member so that a controlled fraction of light output from the light source is utilized for up-lighting, the reflective component adjustable about an axis extending transversely through the extension member such that the direction and degree of up-lighting may be adjusted.

2. The apparatus of claim 1 wherein the reflective component is positioned in the extension member and adjustable about an axis so to change the direction of the up-lighting.

3. The apparatus of claim 1 further comprising a second reflective component a fraction the size of the primary reflector, wherein the second reflective component is positioned in the lower portion of the primary reflector.

4. The apparatus of claim 3 wherein the second reflective component comprises steps of highly reflective material.

5. The apparatus of claim 1 wherein the up-lighting is a fraction of the light energy of the generally controlled, concentrated beam.

6. The apparatus of claim 5 wherein the fractional light energy of the up-lighting is relatively constant along a defined elevation.

7. The apparatus of claim 1 wherein the target area comprises a sports field.

8. The apparatus of claim 1 wherein the blocking an upper margin of the controlled, concentrated beam comprises one or more of the following by the extension member:

a. absorbing some portion of the light energy of the controlled, concentrated beam, or
b. redirecting some portion of the light energy of the controlled, concentrated beam.

9. An apparatus for providing up-lighting from a sports lighting fixture which is adapted to generate a generally controlled, concentrated beam along a central aiming axis to an aiming point on a sports field, the fixture including a reflector with upper and lower portions and a high intensity discharge light source, the apparatus comprising:

a. a visor mounted to the upper portion of the reflector, the visor having exterior and interior surface sides and a length extending generally in the same direction as the central aiming axis to a distal end, a first portion of the length generally diverging from the central aiming axis and a second portion of the length generally converging towards the central aiming axis and terminating at the distal end; and
b. a reflective member mounted at the interior surface side of the visor and oriented relative to the light source and reflector, and to the distal end of the visor, to reflectively divert a portion of the generally controlled, concentrated beam divergingly from the central aiming axis and past the distal end of the visor for up-lighting.

10. The apparatus of claim 9 wherein the length of the visor extends into the controlled, concentrated beam for glare and spill light control.

11. The apparatus of claim 10 wherein the visor comprises a high reflectivity surface.

12. A lighting fixture for lighting a target area from an elevated position, the lighting fixture comprising:

a. a reflector frame at the elevated position having a removable primary reflective surface affixed to the reflector frame adapted for generating a primary light beam angularly downwardly to the target area;
b. a high intensity light source substantially surrounded by the reflector frame and generating a multi-directional light output within the reflector frame;
c. a visor having a visor reflective surface affixed to the visor adapted for directing at least some incident light to the target area, the visor having a distal end away from the reflector frame;
d. a lens rim having opposite sides and separating the reflector frame from the visor, the visor and reflector frame affixed to opposite sides of the lens rim; and
e. an uplight reflective surface (i) affixed to a portion of the fixture proximate the lens, (ii) positioned in the path of the primary light beam and (iii) in an orientation relative to the distal end of the visor so as to direct by reflection some of the light from the light source upwardly above and beyond the distal end of the visor.

13. The apparatus of claim 12 wherein the uplight reflective surface is affixed to the visor.

14. The apparatus of claim 12 wherein the uplight reflective surface is affixed to the reflector frame.

15. The apparatus of claim 12 wherein the uplight reflective surface comprises a highly reflective material.

16. The apparatus of claim 12 wherein the visor has a width and the uplight reflective surface has a width less than the visor.

17. The apparatus of claim 12 wherein the uplight reflective surface is adjustable to various orientations.

* * * * *

UNITED STATES PATENT AND TRADEMARK OFFICE

CERTIFICATE OF CORRECTION

PATENT NO. : 8,523,397 B1
APPLICATION NO. : 11/763867
DATED : September 3, 2013
INVENTOR(S) : Myron Gordin It is certified that error appears in the above-identified patent and that said Letters Patent is hereby corrected as shown below:

Title Page, item (60):
DELETE after No. "60/814,064"
ADD after No. --60/814,094--

Signed and Sealed this
Twenty-second Day of October, 2013

Teresa Stanek Rea
*Deputy Director of the United States Patent and Trademark Office*